US007637256B2

(12) United States Patent
Lee

(10) Patent No.: US 7,637,256 B2
(45) Date of Patent: Dec. 29, 2009

(54) COMPOUND BOW

(76) Inventor: Seul-ki Lee, 101-704 Seongdo Apt. 210 Mohwa-ri, Oedong-eup, Gyeongju-si, Gyeongsangbuk-do (KR)

( * ) Notice: Subject to any disclaimer, the term of this patent is extended or adjusted under 35 U.S.C. 154(b) by 297 days.

(21) Appl. No.: 11/674,169

(22) Filed: Feb. 13, 2007

(65) Prior Publication Data

US 2007/0193568 A1 Aug. 23, 2007

(51) Int. Cl.
*F41B 5/10* (2006.01)

(52) U.S. Cl. ..... 124/25.6

(58) Field of Classification Search ..... 124/25.6
See application file for complete search history.

(56) References Cited

U.S. PATENT DOCUMENTS 6,776,148 B1 * 8/2004 Islas ..... 124/25.6
6,792,931 B1 * 9/2004 Schaar ..... 124/25.6
7,047,958 B1 * 5/2006 Colley ..... 124/25.6

FOREIGN PATENT DOCUMENTS

KR 101997017167 12/1998

* cited by examiner

*Primary Examiner*—John Ricci
(74) *Attorney, Agent, or Firm*—Renner, Otto, Boisselle & Sklar, LLP

(57) ABSTRACT

Compound bow in which a cable interfering with advance of an arrow is removed to improve shooting accuracy of the arrow, to prevent the distortion of the bow, and to simply manipulate equipment of the bow. The compound bow comprises: handle having fixing portions protruding from one surface thereof; wing units coupled to both ends of the handle; rotating units rotatably coupled to free ends of the wing units, respectively, by an eccentric shaft; a bow string connected between the respective rotating units; a pulley shaft-coupled to the fixing portion of the handle; cable members each having one end connected to each rotating unit and the other end connected to the free end of each wing unit via the pulley. Optionally tensioner member may be installed on one side of each cable member and ratchet member may be installed on the respective rotating units and wing units.

16 Claims, 21 Drawing Sheets

COMPOUND BOW

BACKGROUND OF THE INVENTION

1. Field of the Invention

The present invention relates to a compound bow, and more particularly to a compound bow in which a cable connected between an upper wing and a lower wing is removed, and the distortion of a cam is prevented, thereby facilitating maintenance and ease of replacement of parts of the bow.

2. Description of the Prior Art

As generally known in the art, a compound bow is one generally used for hunting which, upon pulling, is easily drawn using a roller type cam or wheel without applying a large force, and upon shooting, increases a shooting force about two times to thereby speed up an arrow with great force.

FIG. 14 is a perspective view of a compound bow according to the prior art, FIG. 15 is a bottom view of a compound bow according to the prior art, and FIG. 16 is a partial enlarged perspective view of a prior compound bow in which a cam thereof is in a distorted state.

As shown in FIGS. 14 to 16, the compound bow includes a handle 10 made of an aluminum material, on both ends of which an upper wing 20 is coupled to the upper end thereof and a lower wing 26 is coupled to the lower end thereof. The upper and lower wings 20 and 28 are provided, at each end 22 and 28, with cut-outs 21 and 27, respectively, in which a cam is rotatably installed by means of an eccentric shaft 70.

The cam consists of an upper cam 30 and a lower cam 36, first and second cables 40 and 46 are respectively connected between the upper cam 30 and the end 28 of the lower wing 26, and the lower cam 36 and the end 22 of the upper wing 20, and a bow string 50 is connected between the upper and lower cams 30 and 36. Here, the first and second cables cross each other in X type.

A cable guide 60 is horizontally installed at one side of the middle portion of the handle 10, the cable guide has a glider 66 movable along the cable guide, and the bow string 50 is inserted in the glider 66.

The glider 66 serves to pull the first and second cables 40 and 46 in one direction. If the first and second cables 40 and 46 are not pulled in one direction, upon shooting an arrow, the arrow and the fletching thereof collide with the first and second cables 40 because the first and second cables 40 and 46 are aligned with the bow string 50.

In the prior compound bow constructed as above, when the bow string 50 is pulled, the upper and lower cams 30 and 36, each having eccentric shafts 70, rotate to wind and draw the first and second cables 40 and 46. At the same time, the upper and lower wings 20 and 26 are curved so that the glider 66 is moved in an end direction of the cable guide 60. Here, the upper and lower cams 30 and 36 come to be distorted.

That is, as shown in FIG. 16, the upper cam 30 is coupled to the end 22 of the upper wing 20 with the eccentric shaft 70, the bow string 50 is coupled at its one end to a large-diameter groove 31 of the upper cam 30, and the first cable 40 is connected between a small-diameter groove 32 of the upper cam 30 and the end 28 of the lower wing 26. In addition, the lower cam 36 is coupled to the end 28 of the lower wing 26 with the eccentric shaft 70, the bow string 50 is coupled at the other end thereof to a large-diameter groove 37 of the lower cam 36, and the second cable 46 is connected between a small-diameter groove 38 of the lower cam 36 and the end 22 of the upper wing 20.

Thus, when the bow string 50 is pulled, the upper and lower cams 30 and 36 rotate about each eccentric shaft 70. Herein, when an arrow is shot after the bow string is pulled to a position where the largest-diameter portions of the cams pass over the respective vertical states about the eccentric shafts 70, the arrow is shot with great force generated due to strong elasticity of the string instantly returning to its original position.

However, in such a compound bow, upon shooting the bow, the first and second cables 40 and 46 and the bow string 50 are in the line, so that the first and second cables 40 and 46 are supported in force in one direction by the cable guide 60 in order to prevent an arrow and the feathers thereof from coming into contact with the first and second cables 40 and 46. Thus, as shown in dotted line in FIG. 16, the upper and lower cams 30 and 36 are distorted about the eccentric shafts 70, so that the ends 22 and 28 of the upper and lower wings 20 and 26 are apt to be deformed, and that, when the bow string 50 is pulled and then released, due to a force of the upper and lower cam 30 and 36 restoring to an original position from a distorted state, the lifetime of the upper and lower wings 20 and 26 becomes shortened, and a trembling effect occurs and the accuracy of the arrow deteriorates.

In order to connect the first and second cables 40 and 46 of the compound bow with the bow string 50, as set forth before, the first and second cables 40 and 46 each are connected between the upper cam 30 and the end 28 of the lower wing 26, and between the lower cam 36 and the end 22 of the upper wing 20, and the bow string then is connected between the upper and lower cams 30 and 36. On the contrary, in the case of maintenance and replacement of the first and second cables 40 and 46 and the bow string 50, the first and second cables 40 and 46, each having been connected between the upper cam 30 and the end of the lower wing 26, and between the lower cam 36 and the end of the upper wing 20, are disconnected in order, the bow string 50, which has been connected between the upper and lower cams 30 and 36, is disconnected, and then the maintenance and replacement are carried out. In order for the connection and/or the disconnection of the first and second cables 40 and 46 and the bow string 50, a special tool, a pool bow press, having the size about two times the compound bow, should be used. However, in the case where the compound bow is used is a plain and the first and second cables 40 and 46, or the bow string 50 should be repaired or replaced, problems arise in that it is impossible to repair or replace the first and second cables 40 and 46, and the bow string 50 without the pool bow press, and that if one carried the pool bow press with him, he is restricted in movement in using the compound bow.

SUMMARY OF THE INVENTION

Accordingly, the present invention has been made to solve the above-mentioned problems occurring in the prior art, and an object of the present invention is to provide a compound bow in which a cable connected between an upper wing and a lower wing is removed, the distortion of a cam is prevented, thereby facilitating maintenance and ease of replacement of parts of the bow.

In order to accomplish this object, there is provided a compound bow comprising: a handle having a pair of parallel fixing portions protruding outward from one surface thereof; a pair of wing units coupled in a longitudinal direction to both ends of the handle; a pair of rotating units rotatably coupled to the free ends of the wing units, respectively, by means of an eccentric shaft; a bow string connected between the respective rotating units; a pulley rotatably shaft-coupled to the fixing portion of the handle; a pair of cable members each having one end connected to each rotating unit and the other end connected to the free end of each wing unit via the pulley;

a tensioner member installed on one side of each cable member to control an angle of each rotating unit and intensity of the bow; and a ratchet member installed on the respective rotating units and wing units to, upon drawing the bow string, prevent the respective rotating units from being restored, and to keep the bow string in a drawable state or an able-to-shoot state.

In an exemplary embodiment, the ratchet member comprises: a ratchet gear provided at one side of the respective rotating units and through which the eccentric shaft passes; a fixing member having a fixing portion fixed to an inside face of one end of each wing unit by the eccentric shaft, and an extension integrally protruding downward from the middle portion of one face of the fixing portion and having a hole thereon; a spring installed in the hole; a support ball provided at an inlet side of the hole so as to be forced by the spring; a ratchet rotatably coupled to the fixing member with a pin and having, on both ends of one side thereof, a pair of engaging projections engaged with gear teeth of the ratchet gear to rotate the ratchet gear only in clockwise or counterclockwise direction, and on the other side thereof, a support projection resiliently supported by the support ball; a plurality of through-holes provided at one side of the periphery of an eccentric opening of each rotating unit, through which the eccentric shaft is fastened; and a turnabout piece inserted into and installed in the through-hole to contact the support projection of the ratchet according to the rotating direction of the respective rotating units to rotate the ratchet so as to allow one of engaging projections to be selectively engaged with the ratchet gear.

BRIEF DESCRIPTION OF THE DRAWINGS

The above and other objects, features and advantages of the present invention will be more apparent from the following detailed description taken in conjunction with the accompanying drawings, in which:

FIG. 5 is a view illustrating the operational states of the compound bow of the present invention, wherein

FIG. 6 is a view illustrating the operational states of the ratchet member in FIG. 5, wherein

FIG. 12 is a view illustrating the operational states of the ratchet member in a second embodiment of the invention, wherein

DETAILED DESCRIPTION OF THE PREFERRED EMBODIMENTS

Figure 1:
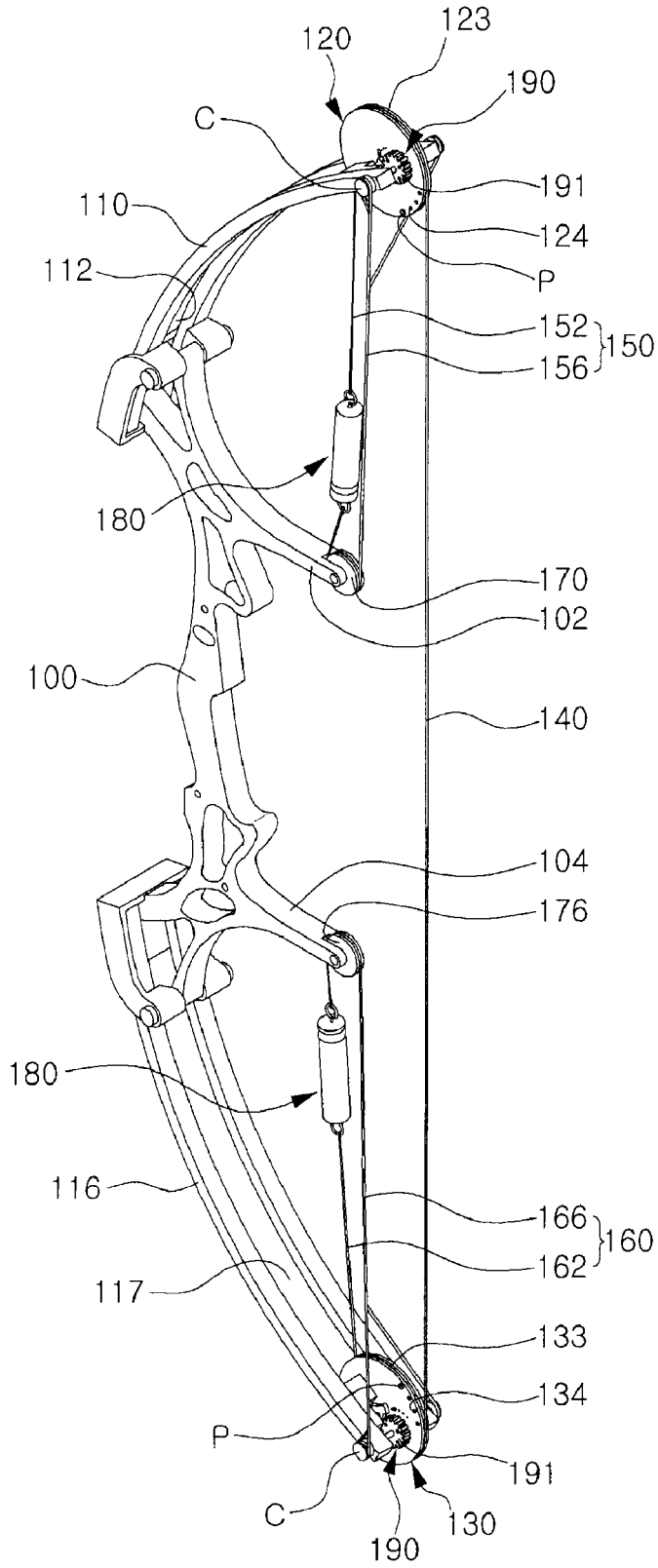
FIG. 1 is a general perspective view of a compound bow according to a first embodiment of the present invention.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
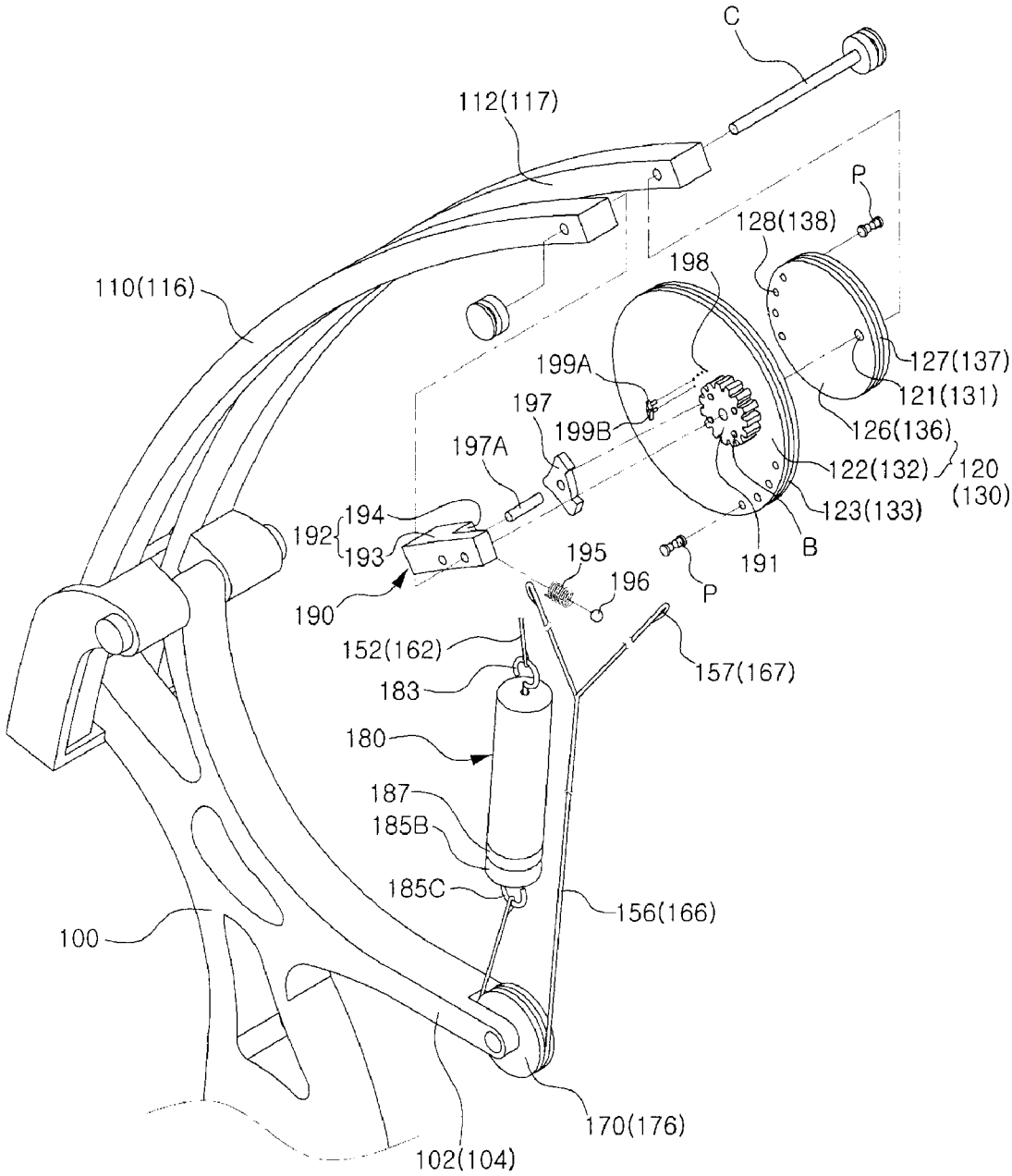
FIG. 2 is an exploded perspective view of main parts of the compound bow according to the first embodiment.
Figure 3:
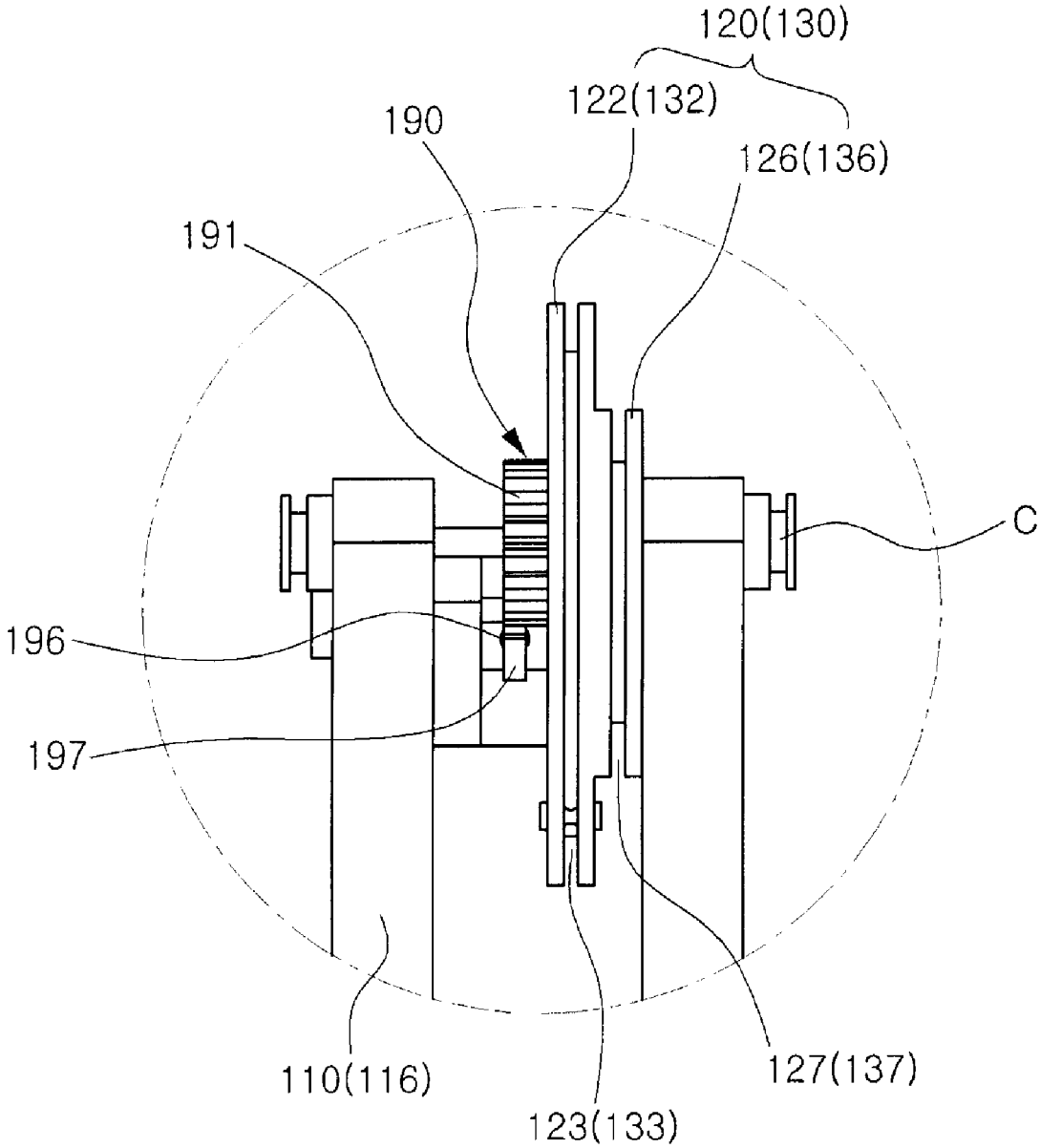
FIG. 3 is a partial enlarged side view illustrating a state in which a ratchet member is coupled to rotating units and wing units in FIG. 1.
Figure 4:
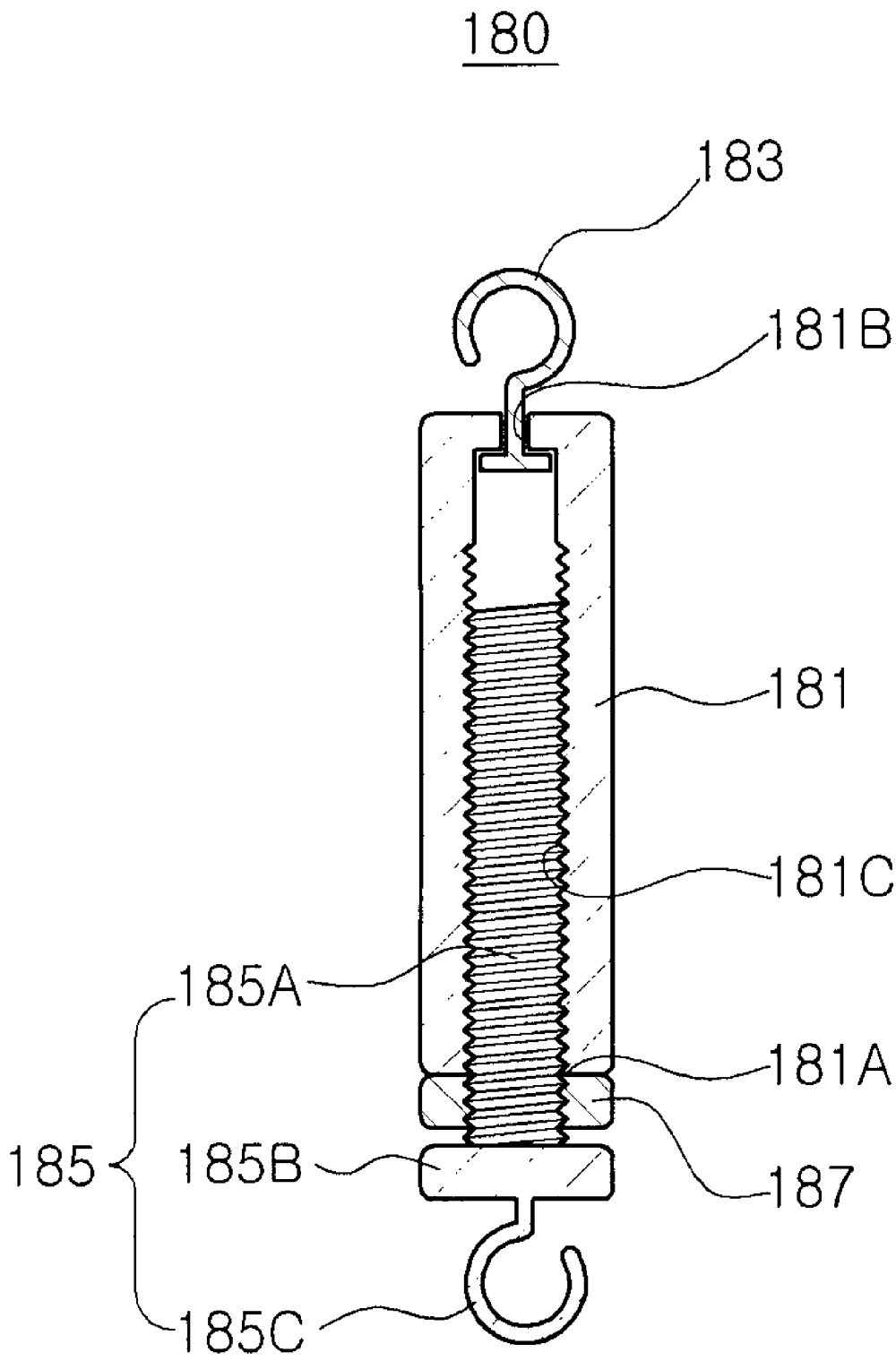
FIG. 4 is a sectional view of a tensioner member that is installed on a cable member in FIG. 1.

FIG. 1 is a general perspective view of a compound bow according to a first embodiment of the present invention, FIG. 2 is an exploded perspective view of main parts of the compound bow according to the first embodiment, FIG. 3 is a partial enlarged side view illustrating a state in which a ratchet member is coupled to rotating units and wing units in FIG. 1, and FIG. 4 is a sectional view of a tensioner member that is installed on a cable member in FIG. 1.

As illustrated in FIGS. 1 to 4, the compound bow includes a handle 100, wing units, rotating units, a bow string 140, a cable member, a tensioner member 180, and a ratchet member 190.

Specifically, the handle 100 corresponds to the middle main body, and has parallel fixing portions 102 and 104 protruding from its one face. A grip is coupled to the middle of the handle 100.

The wing unit is formed curved, one end of which is coupled in a longitudinal direction to both ends of the handle 100, and includes an upper wing 110 and a lower wing 116. Cut-out portions 112 and 117 are formed at the other ends of the upper and lower wings 110 and 116, respectively.

Referring to FIG. 2, the rotating unit consists of an upper cam member 120 and a lower cam member 130, each being rotatably coupled to each cut-out portion 112 and 117 of the upper and lower wings 110 and 116 by means of an eccentric shaft C such that, upon pulling the bow, a pulling force is somewhat strong, but, after the pulling, a change occurs in the center of the eccentric shaft C of the rotating unit and the pulling force is weakened to about one-half thereof, thereby allowing a long time for aiming.

The upper and lower cam members 120 and 130 each have a first cam 122, 132 and a second cam 126, 136 integrally formed at one side of the first cam 122, 132 and having a smaller diameter.

The upper and lower cam members 120 and 130 each have, at one side each, an eccentric opening 121, 131, through which the eccentric shaft C is inserted.

The first cam 122, 132 and the second cam 126, 136 include a first groove 123, 133 and a second groove 127, 137, respectively.

A bow string 140 to be described later is wound onto and coupled to the respective first grooves 123 and 133, and the cable member is wound onto and coupled to the respective second grooves 127 and 137.

A plurality of length-adjusting holes 124, 134 is formed at one side of the periphery of the first cams 122 and 132, respectively, to adjust a length of the bow string 140 to be pulled, and a plurality of intensity-adjusting holes 128, 138, to which one ends of the cable members each are connected, is formed at the other side of the periphery of the second cams 126 and 136, respectively, to adjust the intensity of the bow.

While the rotating unit has been described herein as the cam, it is not limited thereto, and may also use a pulley type wheel.

The bow string 140 is an important element that is connected between the upper cam member 120 and the lower cam member 130 to have an effect on the basic performance of the bow, such as the speed and orientation of an arrow. The bow string 140 has, at both ends, loops held by fixing pins P inserted into the length-adjusting holes 124 and 134, respectively.

The pulleys 170 and 176 are shaft-coupled to fixing portions 102 and 104 to change directions of upper and lower cables 150 and 160, respectively.

The cable member consists of the upper and lower cables 150 and 160, each being, at one end thereof, connected to the second cam 126, 136 of the upper/lower cam member 120, 130, and, at the other end thereof, being connected to the free end of the upper/lower wing 110, 116 via the pulley 170, 176, thereby providing intensity of the bow, and flying stability and high speed of an arrow.

The upper/lower cable 150, 160 consists of a first cable 152, 162 and a second cable 156, 166.

Each first cable 152, 162 is provided, at its one end, with a loop 153, 163 held by the fixing pin P inserted into an intensity-adjusting hole 128, 138. Each second cable 156, 166 is provided, at its one end, with a loop 157 held by the eccentric shaft C installed on the end of the upper/lower wing 110, 116. In addition, the first and second cables 152, 162, and 156, 166 are provided, at the other ends thereof, with loops 153 and 157 to which a tensioner member 180 to be described later is installed.

The tensioner member 180 is installed on the cable member turned about by the pulley 170, 176 to adjust an angle of the rotating unit and intensity of the wing unit. That is, it is installed between the first cable 152 and the second cable 156 of the upper cable 150 to adjust an angle of the upper cam member 120 and intensity of the upper wing 110. Further, it is installed between the first cable 162 and the second cable 166 of the lower cable 160 to adjust an angle of the lower cam member 130 and intensity of the lower wing 116.

Such a tensioner member 180, as shown in FIG. 4, includes a main body 181, a first connection hook 183, a tensioner 185, and a tension-fixing nut 187.

The main body 181 has a fastening portion 181A and a hook hole 181B at both ends, respectively, and an internally threaded portion 181C formed in a longitudinal direction at an inner periphery thereof.

The first connection hook 183 is coupled to the hook hole 181B to connect with the loops 153 and 163 of the first cables 152 and 162 of the upper and lower cables 150 and 160.

The tensioner 185 includes an adjusting bolt 185A inserted through the fastening portion 181A to engage the internally threaded portion 181C, a nut 185B integrally formed at one side of the adjusting bolt 185A, and a second connection hook 185C integrally formed protruding from one side of the nut 185B to connect with the loops 157 and 167 of the second cables 156 and 166 of the upper and lower cables 150 and 160.

The tension-fixing nut 187 fixes the tensioner 185 through screw-fastening to the adjusting bolt 185A.

The ratchet member 190 is installed on the upper and lower cam members 120 and 130 and the upper and lower wings 110 and 116, such that, upon pulling the bow string 140, the upper and lower cam members 120 and 130 are prevented from being restored, and that the bow string 140 is kept in a drawable state or an able-to-shoot state. The ratchet member 190 includes a ratchet gear 191, a fixing member 192, a spring 195, a support ball 196, a fixing pin 197A, and turnabout pieces 199A and 199B.

The ratchet gear 191 is fixedly installed on one side of the first cams 122 and 132 of the upper and lower cam members 120 and 130, through which the eccentric shaft C pass, by means of a plurality of fastening bolts B.

The fixing member 192 has a fixing portion 193 fixed to an inside face of one end of the upper/lower wing 110, 116 by the eccentric shaft C, and an extension 194 integrally protruding downward from the middle portion of one face of the fixing portion 193 and having a hole 194A thereon.

The spring 195 is installed in the hole 194A, and the support ball 196 is provided at an inlet side of the hole 194A so as to be forced by the spring 195.

The support ball 196 forced by the spring 195 allows engaging projections 197B to be engaged with the gear teeth 191A, and controls the rotating operation of the ratchet gear 191.

The ratchet 197 rotatably coupled to the fixing member 192 with the fixing pin 197A to control the rotating operation of the ratchet gear 191. The ratchet has, on both ends of one side thereof, the engaging projections 197B engaged with the gear teeth 191A of the ratchet gear 191, on the other side thereof, a support projection 197C associated with the support ball 196, and on middle both ends thereof, contact projections 197D to be described.

A pair of turnabout pieces 199A and 199B are provided such that they are inserted into and installed on through-holes 198, which are provided at one side of the periphery of the eccentric holes 121 and 131 of the upper and lower cam members 120 and 130, to turn about a direction of the ratchet 197, coming to contact with the contact projections 197D by the rotating motion of the rotating unit.

The through-holes 198 adjust the pulled length of the bow string 140 and the turnabout speed of the ratchet 197 when the bow string 140 is pulled. The positions of the turnabout pieces 199A and 199B installed on the through-holes 198 are determined by the contact projection 197D of the ratchet 197.

Between the turnabout pieces 199A and 199B installed on the through-holes 198 formed in the upper and lower cam members 120 and 130, one turnabout piece 199A serves to switch the bow string 150 into an able-to-shoot state upon pulling, and the other turnabout piece 199B serves to switch the bow string 150 into a drawable state upon releasing.

The operation of the present invention configured as above will now be explained.

First, the upper and lower wings 110 and 116 are coupled to both ends of the handle 100, and the upper and lower cam members 120 and 130 are rotatably coupled to the cut-out portions 112 and 117 of the upper and lower wings 110 and 116 by means of the eccentric shaft C. Herein, the upper and lower cam members 120 and 130, and the upper and lower wings 110 and 116 are respectively provided with the ratchet member 190, and the respective fixing portions 102 and 104 of the handle 100 are respectively provided with the pulleys 170 and 176.

Figure 5A:
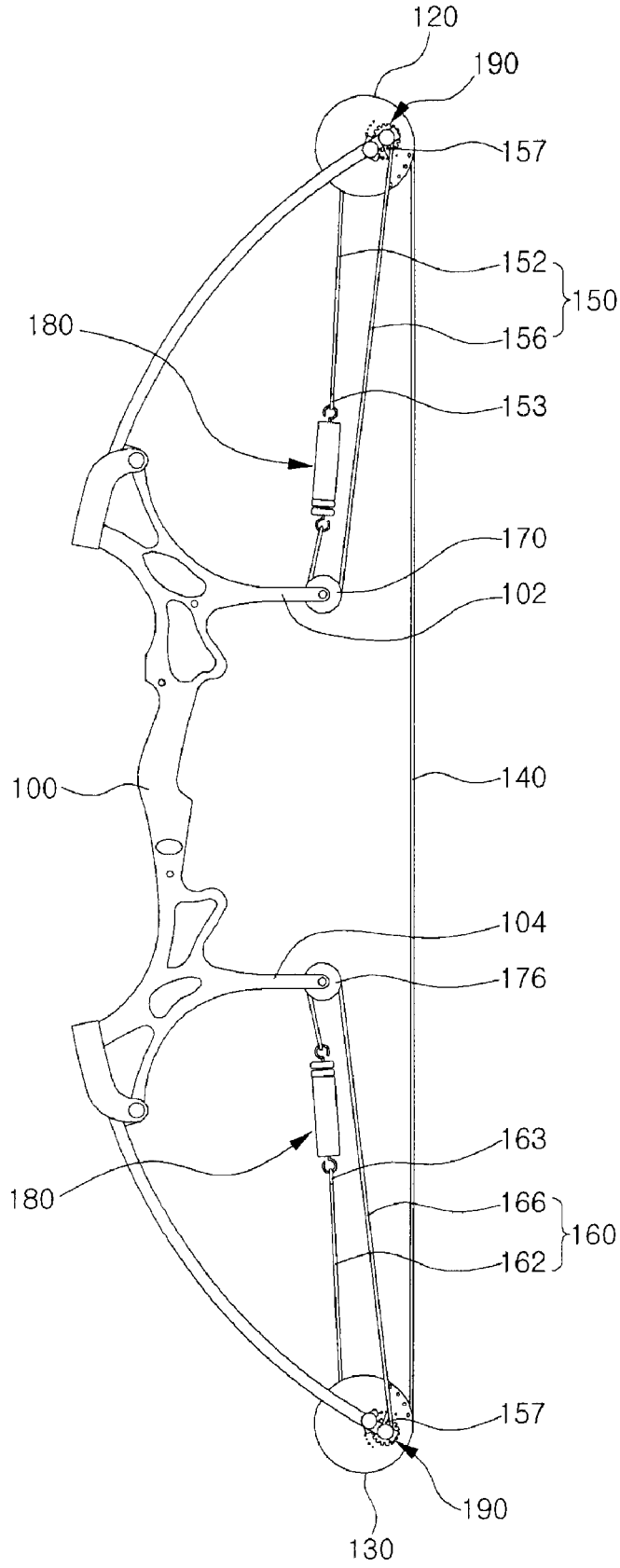
FIG. 5A is a side view showing the state before pulling a bow string.

Next, the bow string 140 is connected to the upper and lower cam members 120 and 130. That is, the loop 142 formed at one end of the bow string 140 is so connected as to be held by the fixing pin P that is inserted into the length-adjusting hole 124 formed in the first cam 122 of the upper cam member 120, and the loop 142 formed at the other end of the bow string 140 is so connected as to be held by the fixing pin P that is inserted into the length-adjusting hole 134 formed in the first cam 132 of the lower cam member 130. Then, the loop 153 formed at one end of the first cable 152 of the upper cable 150 is fixedly held by the fixing pin P that is inserted into the intensity-adjusting hole 128 of the second cam 126 formed in the upper cam member 120, and the loop 157 formed at one end of the second cable 156 is connected to the end of the upper wing 110, and then the tensioner member 180 is installed on the loop 153 formed at the other end of the first cable 152, and the loop 157 formed at the other end of the second cable 156. Similarly, the loop 163 formed at one end of the first cable 162 of the lower cable 160 is fixedly held by the fixing pin P that is inserted into the intensity-adjusting hole 138 of the second cam 136 formed in the lower cam member 130, and the loop 167 formed at one end of the second cable 166 is connected to the end of the lower wing 116, and then the tensioner member 180 is installed on the loop 163 formed at the other end of the first cable 162, and the loop 167 formed at the other end of the second cable 166 (See FIG. 5A).

Figure 5B:
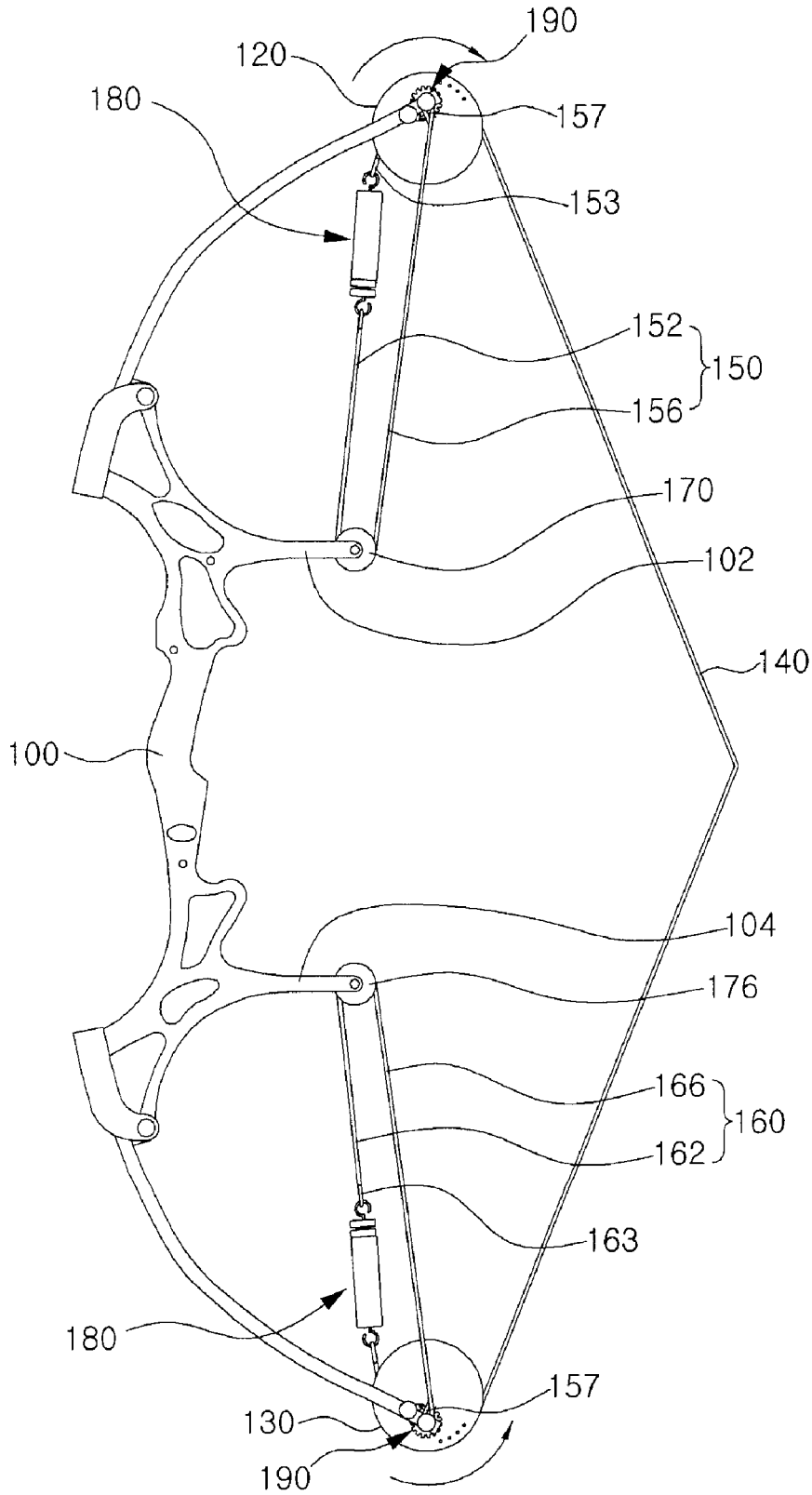
FIG. 5B is a side view showing the state when pulling the bow string.

In order to use such a compound bow configured as above, when an arrow (not shown) is put to the bow string 140 and is pulled as shown in FIG. 5B, the upper and lower cam members 120 and 130 rotate and the bow string 140 wound around the first grooves 123 and 133 of the first cams 122 and 132 is released at both ends thereof to elongate, and at the same time, the upper and lower cables 150 and 160 are wound around the second grooves 127 and 137 of the second cams 126 and 136 to tense the upper and lower wings 110 and 116. When the pulled bow string 140 is instantaneously pulled off, the upper and lower cam members 120 and 130 are restored to gain powerful momentum at the very moment that an arrow is shot, so that the conventional cable crossed in X type is removed to thereby increase the accuracy of the compound bow, and that the distortion of the rotating unit is avoided to thereby prevent the deformation of the wing unit.

Herein, the operational procedure of the ratchet member 190 when the bow string 140 is pulled and then released will now be described.

Figure 6A:
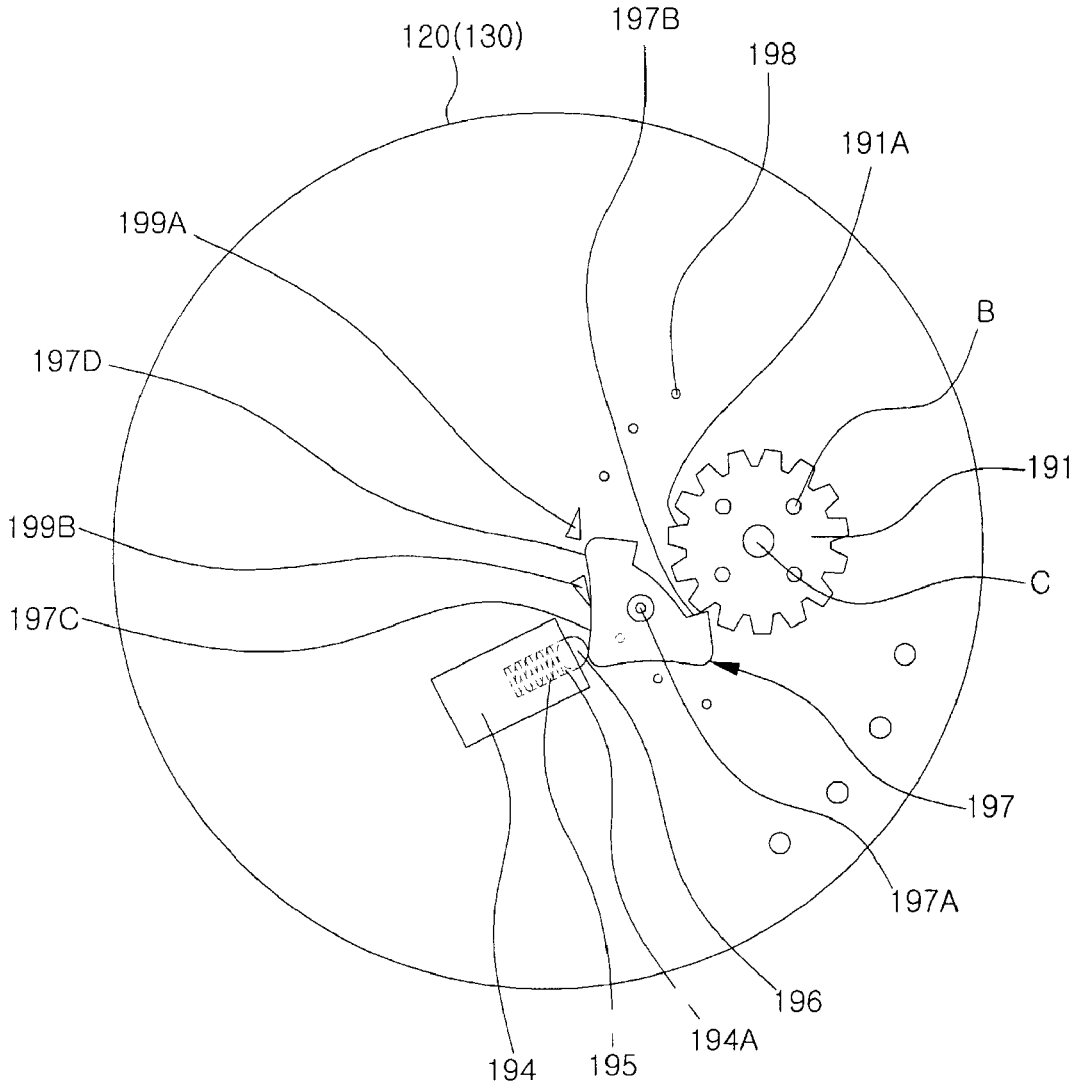
FIG. 6A shows the state before pulling the bow string.
Figure 6B:
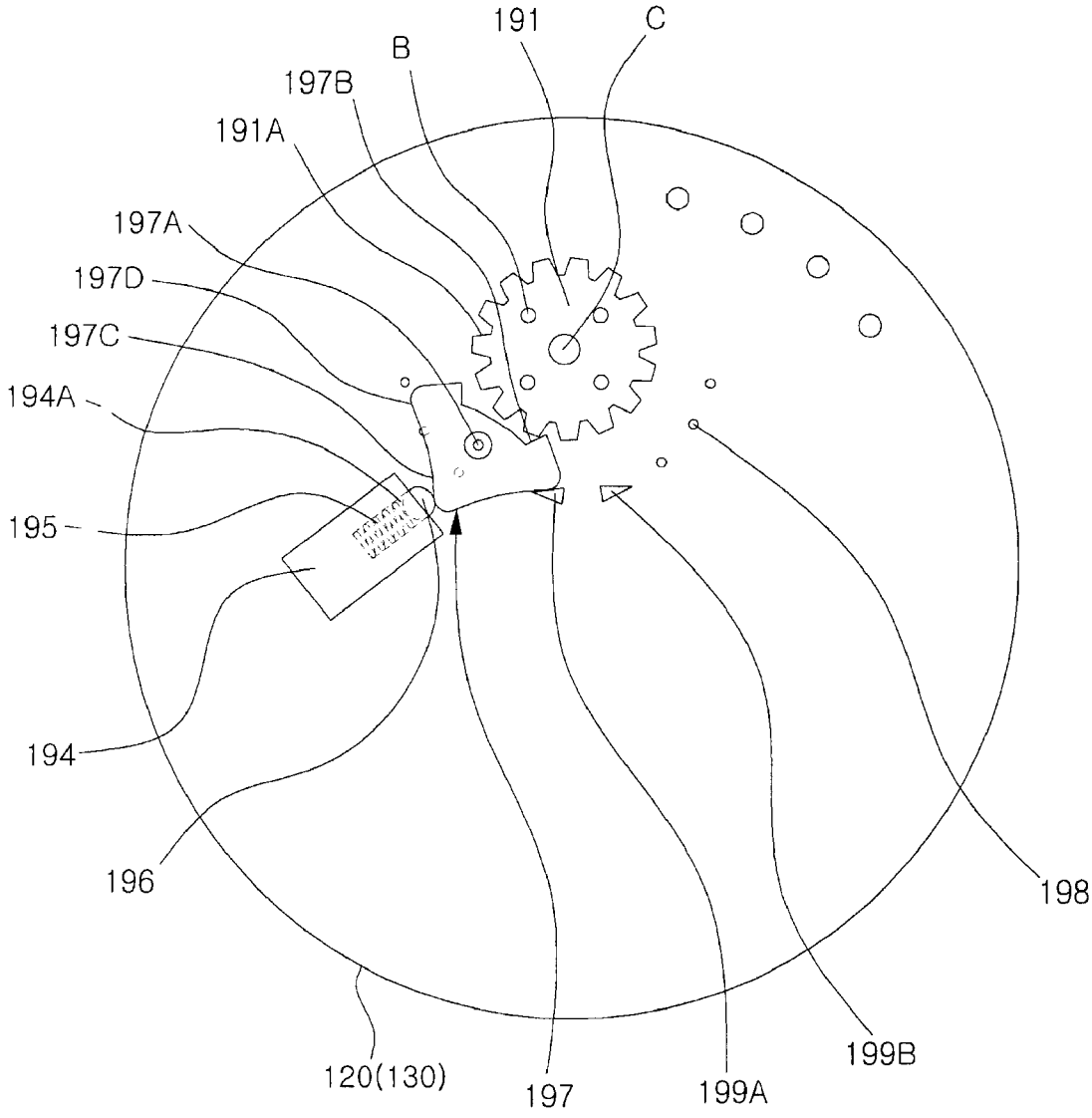
FIG. 6B shows the state when pulling the bow string.
Figure 6C:
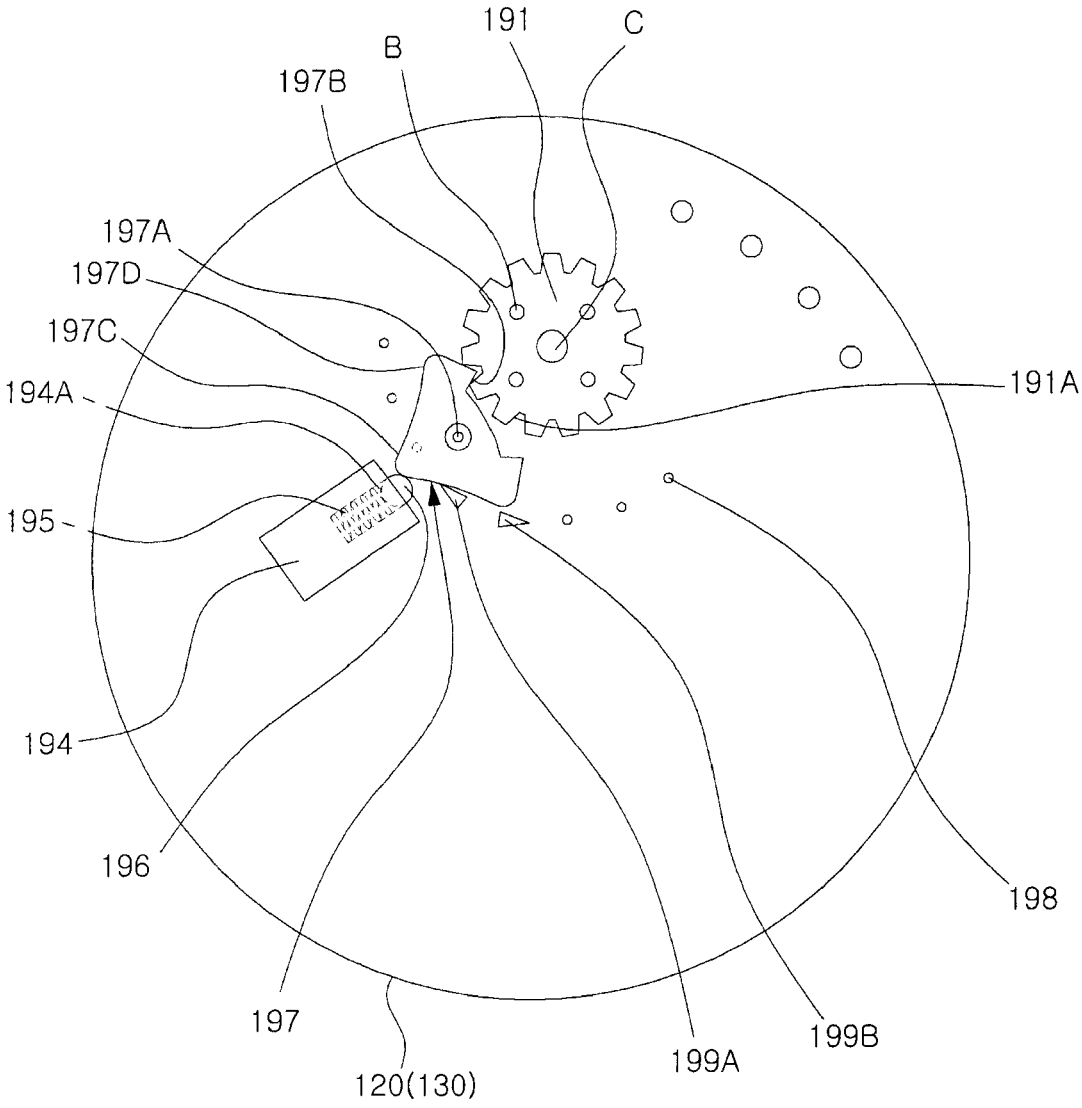
FIG. 6C shows the state after completely pulling the bow string.

As shown in FIG. 6A, the other side engaging projection 197B (lower side in FIG. 6A) formed on the ratchet 197 is engaged with the gear teeth 191A of the ratchet gear 191, the other side turnabout piece 199B is positioned on the bottom face of one side contact projection 197D, the support ball 196 is in the state where it is positioned in one side direction (upper direction) from the end of the support projection 197C, and the bow string 140 is pulled. Then, as shown in FIG. 6B, the upper and lower cam members 120 and 130 rotate about the eccentric shaft C, so that one side turnabout piece 199A is positioned on the bottom face of the other side contact projection 197D. Herein, even when the pulled bow string 140 is pulled off, the bow string 140 and the upper and lower cam members 120 and 130 are not restored to their original states, but are maintained at their current states. In this state, when the bow string 140 is furthermore pulled, as shown in FIG. 6C, one side turnabout piece 199A slides in a direction of the support projection 197C, so that a direction of the ratchet 197 is turned about. Thus, one side engaging projection 197B (upper side in FIG. 6C) of the ratchet 197 is engaged with the gear teeth 191A, and the support ball 196 is positioned in the other side direction (lower) from the end of the support projection 197C, thereby entering an able-to-shoot state.

In this state, when the bow string 140 is pulled off, the upper and lower cam members 120 and 130 are restored, so that as shown in FIG. 6A, the other side engaging projection 197B of the ratchet 197 is engaged with the gear teeth 191A, the other side turnabout piece 199B is positioned on the bottom of one side contact projection 197D and thus the bow string 140 enters a drawable state, and the support ball 196 is positioned in the other side direction from the end of the support projection 197C.

Meanwhile, the operational state of the tensioner member for adjusting the angle of the rotating unit and intensity of the bow will now be explained referring to the accompanying drawings.

Figure 7:
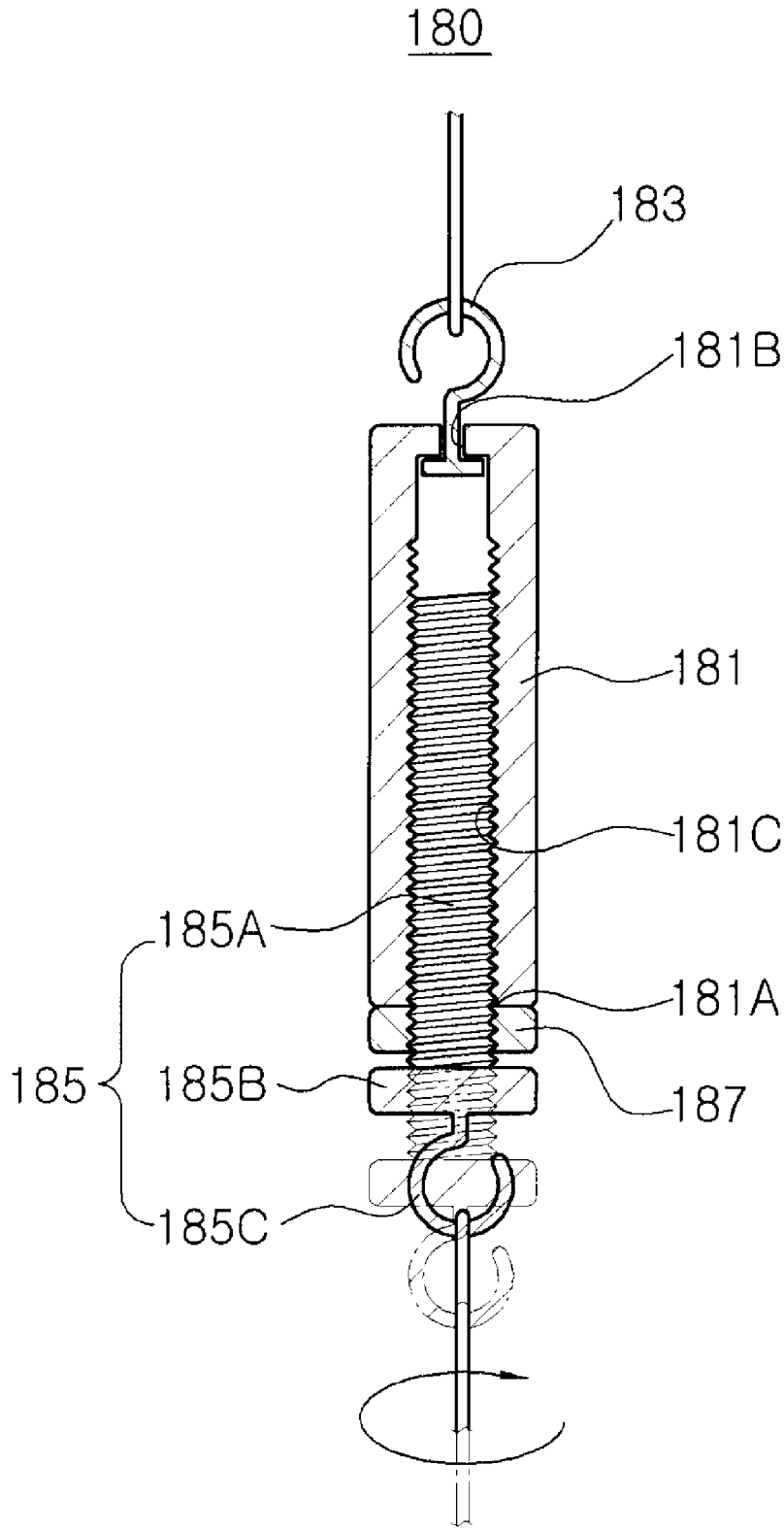
FIG. 7 is a view illustrating the use state of a tensioner member according to the present invention.

When trying to intensify a force to pull the bow string 140, one rotates the tensioner 185 in a clockwise direction, i.e., an arrow direction in FIG. 7, so that the adjusting bolt 185A is screwed into the internally threaded portion 181C of the main body 181 in the direction of the first connection hook 183 to thereby shorten the whole length of the tensioner member 180 and also to draw the upper and lower cam members 120 and 130, thereby intensifying the pulling force of the bow string 140. On the contrary, when trying to weaken the pulling force of the bow string 140, one rotates the tensioner 185 in a counter-clockwise direction, so that the adjusting bolt 185A is released from the internally threaded portion 181C and thus the tensioner 185 moves in a dashed dotted line in FIG. 7 to thereby elongate the whole length of the tensioner member 180 and also to release the upper and lower cam members 120 and 130, thereby weakening the pulling force of the bow string 140. Accordingly, the tensioner member 180 is able to facilitate the connection of the cable member, to adjust an angle of the upper and lower cam members 120 and 130, to adjust intensity of the upper and lower wings 110 and 116, and to facilitate maintenance and replacement of the bow string 140 and the cable member.

Figure 8:
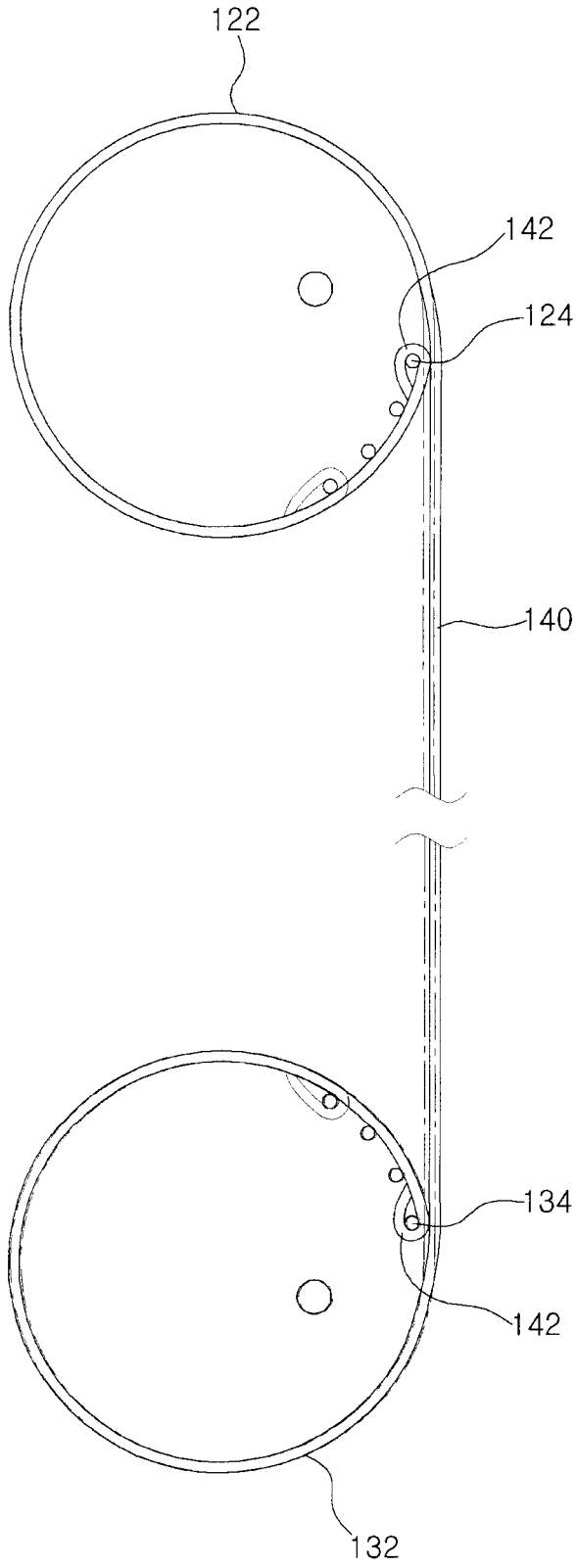
FIG. 8 is a view illustrating the state where the bow string is disposed in a length-adjusting hole to adjust a length of the bow string to be pulled.
Figure 9:
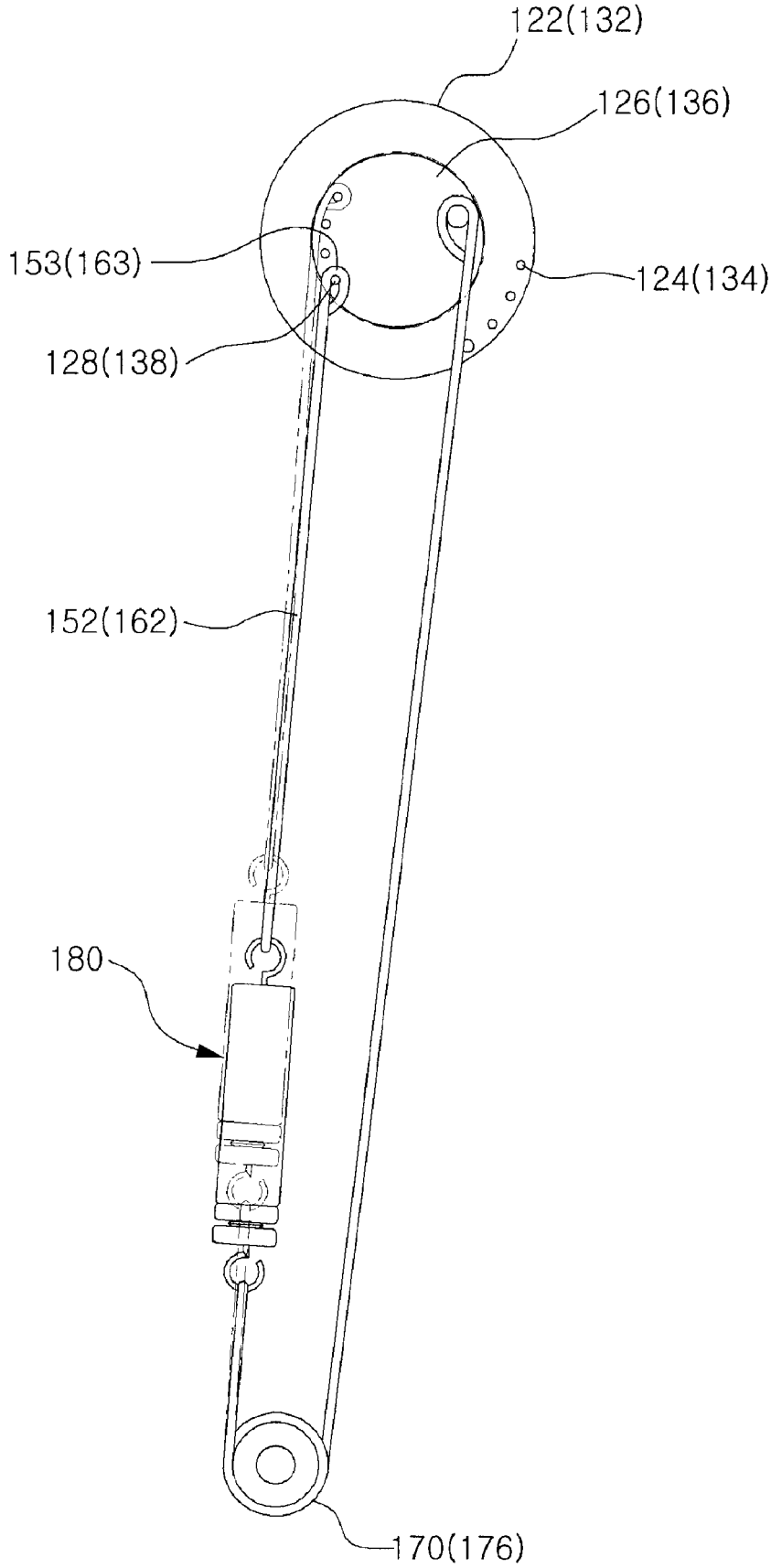
FIG. 9 is a view illustrating the state where the cable member is installed on an intensity-adjusting hole to adjust intensity of the bow according to the present invention.

FIG. 8 is a view illustrating the state where the bow string is disposed in the length-adjusting hole to adjust a length of the bow string to be pulled, and FIG. 9 is a view illustrating the state where the cable member is installed on the intensity-adjusting hole to adjust intensity of the bow according to the present invention.

The operational state for adjusting the length of the bow string 140 to be pulled will now be explained with reference to FIG. 8.

First, when trying to shorten the pulling length of the bow string 140, loops formed at both ends of the bow string 140, as indicated by the dashed dotted line in FIG. 8, are fixedly disposed in the length-adjusting holes formed at one side end by means of the fixing pin, and when trying to elongate the pulling length of the bow string 140, loops 142 formed at both ends of the bow string 140, as indicated by the solid line in FIG. 8, are fixedly disposed in the length-adjusting holes 124 and 134 formed at the other side end by means of the fixing pin. Thus, in accordance with a user's body condition and use purpose, the pulling length of the bow string can be adjusted.

The operational state for adjusting intensity of the compound bow will now be explained with reference to FIG. 9.

First, when trying to weaken the intensity of the bow, loops formed at one ends of the first cables of the cable members, as indicated by the dashed dotted line in FIG. 9, are fixedly disposed in the intensity-adjusting hole formed at one side end by means of the fixing pin, and when trying to intensify the compound bow, loops 153 and 163 formed at bone ends of the first cables 152 and 162 of the cable members, as indicated by the solid line in FIG. 9, are fixedly disposed in the intensity-adjusting holes 128 and 138 formed at the other side end by means of the fixing pin.

Figure 10:
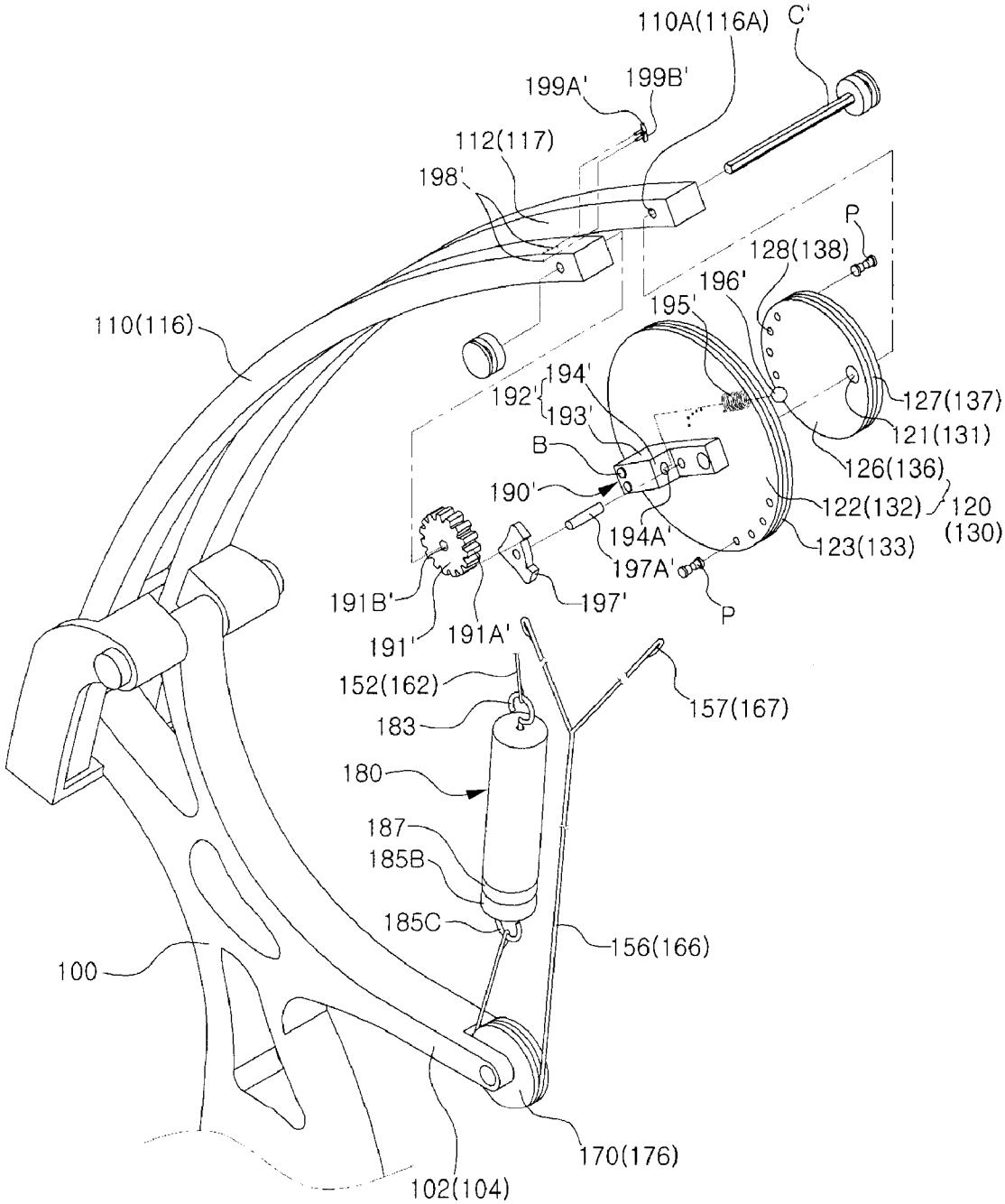
FIG. 10 is an exploded perspective view of main parts of a compound bow according to a second embodiment of the invention.
Figure 11:
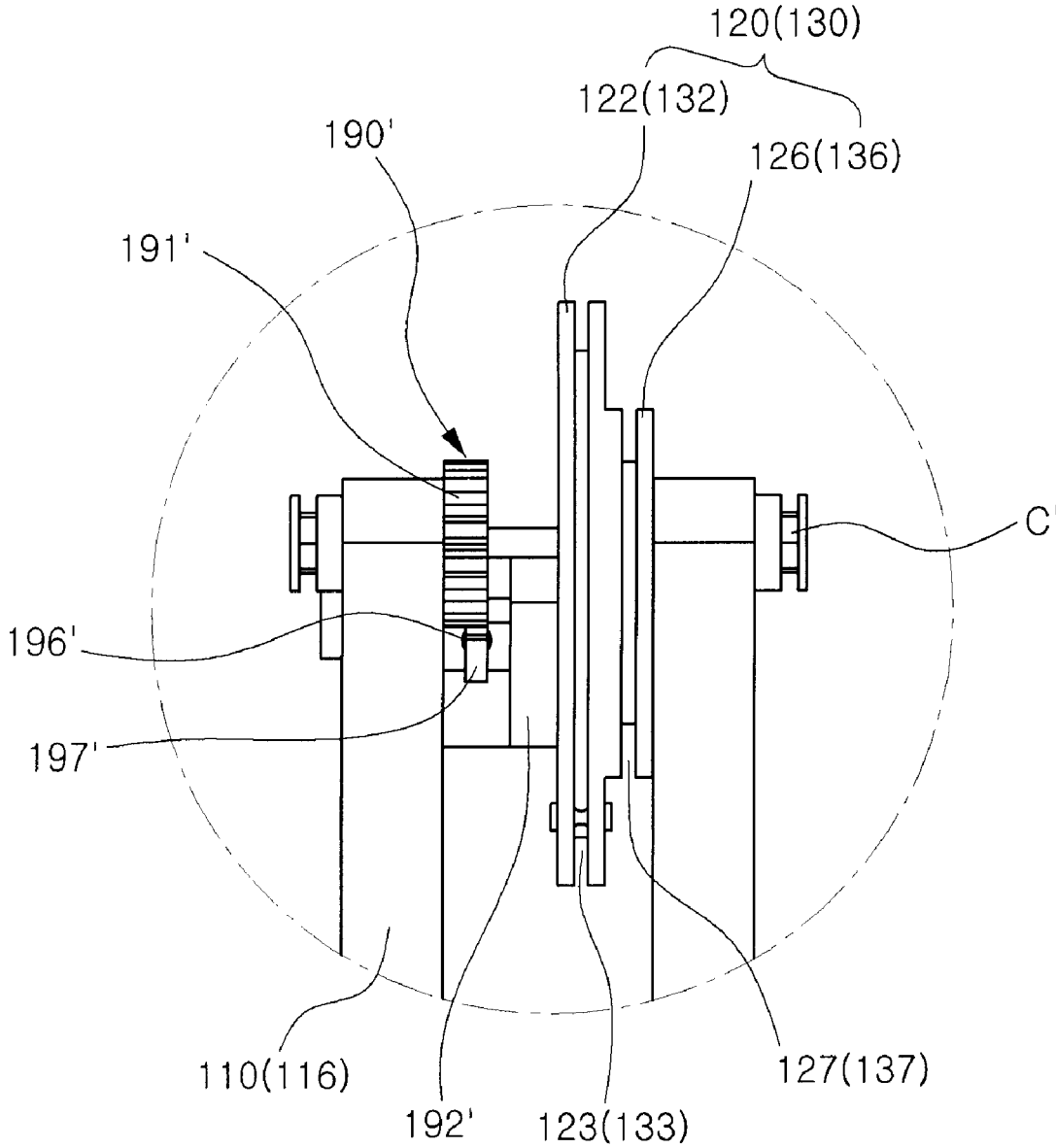
FIG. 11 is a partial enlarged side view illustrating a state in which a ratchet member is coupled to rotating units and wing units in FIG. 10.

FIG. 10 is an exploded perspective view of main parts of a compound bow according to a second embodiment of the invention, and FIG. 11 is a partial enlarged side view illustrating a state in which a ratchet member is coupled to rotating units and wing units in FIG. 10.

The compound bow according to the second embodiment includes a handle 100, wing units, rotating units, a bow string 140, a cable member, a tensioner member 180, and a ratchet member 190. Detailed description thereof will be made of only the modified construction other than the same construction as above-mentioned first embodiment. The reference numerals to be hereinafter used are the same as those of the first embodiment.

As shown in FIGS. 10 and 11, the ratchet member 190 is installed on the upper and lower cam members 120 and 130 and the upper and lower wings 110 and 116, such that, upon pulling the bow string 140, the upper and lower cam members 120 and 130 are prevented from being restored, and that the bow string 140 is kept in a drawable state or an able-to-shoot state. The ratchet member 190 includes a ratchet gear 191', a fixing member 192', a spring 195', a support ball 196', a fixing pin 197A', and turnabout pieces 199A' and 199B'.

The ratchet gear 191' is positioned between one side of the first cam 122, 132 and the cut-out portion 112, 117 of the upper/lower wing 110, 116, and is fixedly installed by an eccentric shaft C'.

The eccentric shaft C' is shaped like a polygon, such as a tetragon, a pentagon, a hexagon, octagon, in order for the ratchet gear 191' not to be rotated. In the second embodiment, it is shaped like a hexagon. An inner diameter of the eccentric hole 121, 131 formed at the upper/lower cam member 120, 130 is formed larger than an outer diameter of the eccentric shaft C'.

Depending upon the shape of the eccentric shaft C', a ratchet hole 191B' of the ratchet gear 191' and a wing hole 110A, 116A formed on the upper/lower wing 110, 116, through which the eccentric shaft C' passes, are formed preferably in the same shape.

The fixing member 192' has a fixing portion 193' fixedly installed on one side face of the first cam 122 by a fastening bolt B, and an extension 194' integrally protruding downward from the middle portion of one face of the fixing portion 193' and having a hole 194A' thereon.

The spring 195' is installed in the hole 194A', and the support ball 196' is provided at an inlet side of the hole 194A' so as to be forced by the spring 195'.

The support ball 196' forced by the spring 195' allows engaging projections 197B' to be engaged with the gear teeth 191A', and controls the rotating operation of the ratchet gear 191'.

The ratchet 197' is installed on the fixing member 192' with the fixing pin 197A', and has, on both ends of one side thereof, the engaging projections 197B' engaged with the gear teeth 191A' of the ratchet gear 191', on the other side thereof, a support projection 197C' associated with the support ball 196', and on middle both ends thereof, contact projections 197D' to be described.

A pair of turnabout pieces 199A' and 199B' are provided such that they are inserted into and oppositely installed on through-holes 198', which are provided at an inner face of one end of the wing unit, to turn about a direction of the ratchet 197', coming to contact with the contact projections 197D' by the rotating motion of the rotating unit.

The through-holes 198' provided at an inner face of one end of the wing unit adjust the pulled length of the bow string 140 and the turnabout speed of the ratchet 197' when the bow string 140 is pulled. The positions of the turnabout pieces 199A' and 199B' installed on the through-holes 198' are determined by the contact projection 197D' of the ratchet 197'.

Between the turnabout pieces 199A' and 199B' installed on the through-holes 198', one turnabout piece 199A' serves to switch the bow string 140 into an able-to-shoot state upon pulling, and the other turnabout piece 199B' serves to switch the bow string 140 into a drawable state upon releasing.

The operation of the second embodiment configured as above is the same as described above. In the meantime, upon pulling and releasing the bow string 140, the first embodiment has a construction of ratchet member in which upon the rotation of the upper/lower cam member 120, 130, the ratchet gear 191 is also rotated, and the second embodiment of the invention, however, has a construction of ratchet member in which upon the rotation of the upper/lower cam member 120, 130, the ratchet gear 191 is not rotated, but the fixing member 192' is rotated together. Both effects thereof are the same each other.

In addition, while the turnabout pieces 199A and 199B in the first embodiment has the construction in which they are installed on the upper/lower cam members 120 and 130, and upon the rotation of the cam members, they are rotated together with the cam members, the turnabout pieces 199A' and 199B' in the second embodiment has the construction in which they are installed on the inner face of one end of the upper/lower wings 110 and 116, and upon the rotation of the cam members, they are not rotated together with the cam members.

The operational procedure of the ratchet member when the bow string is pulled and then released will now be described.

Figure 12A:
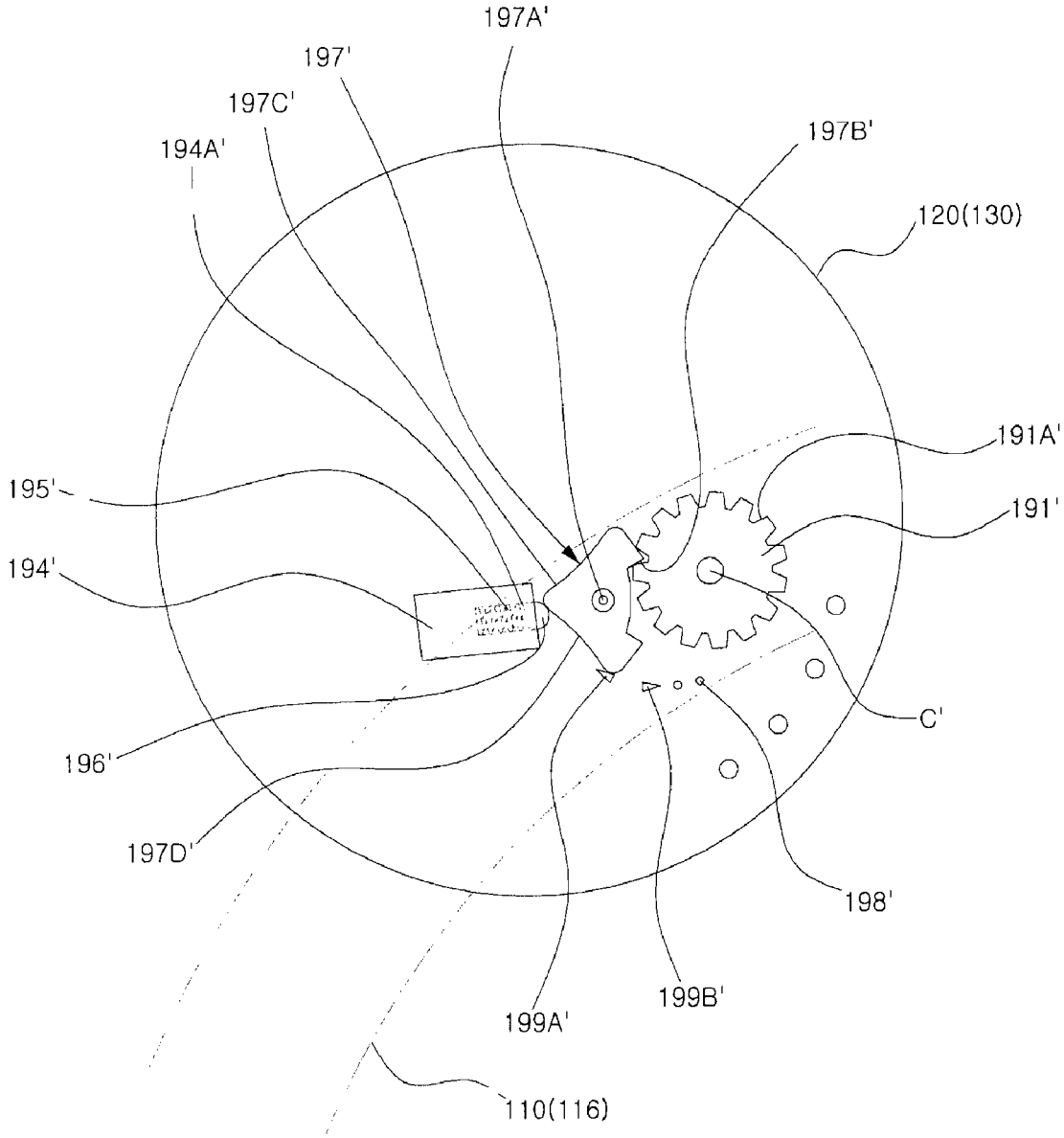
FIG. 12A shows the state before pulling the bow string.
Figure 12B:
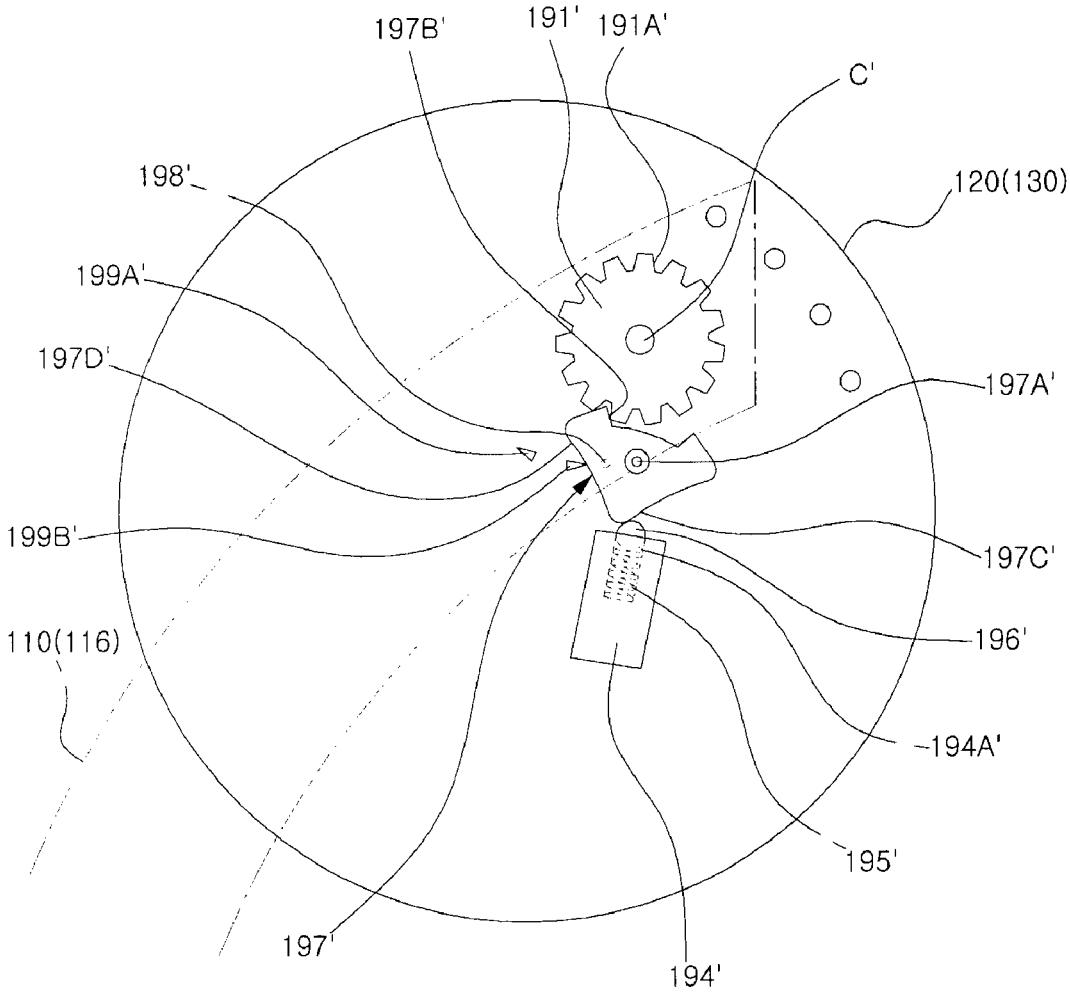
FIG. 12B shows the state when pulling the bow string.
Figure 12C:
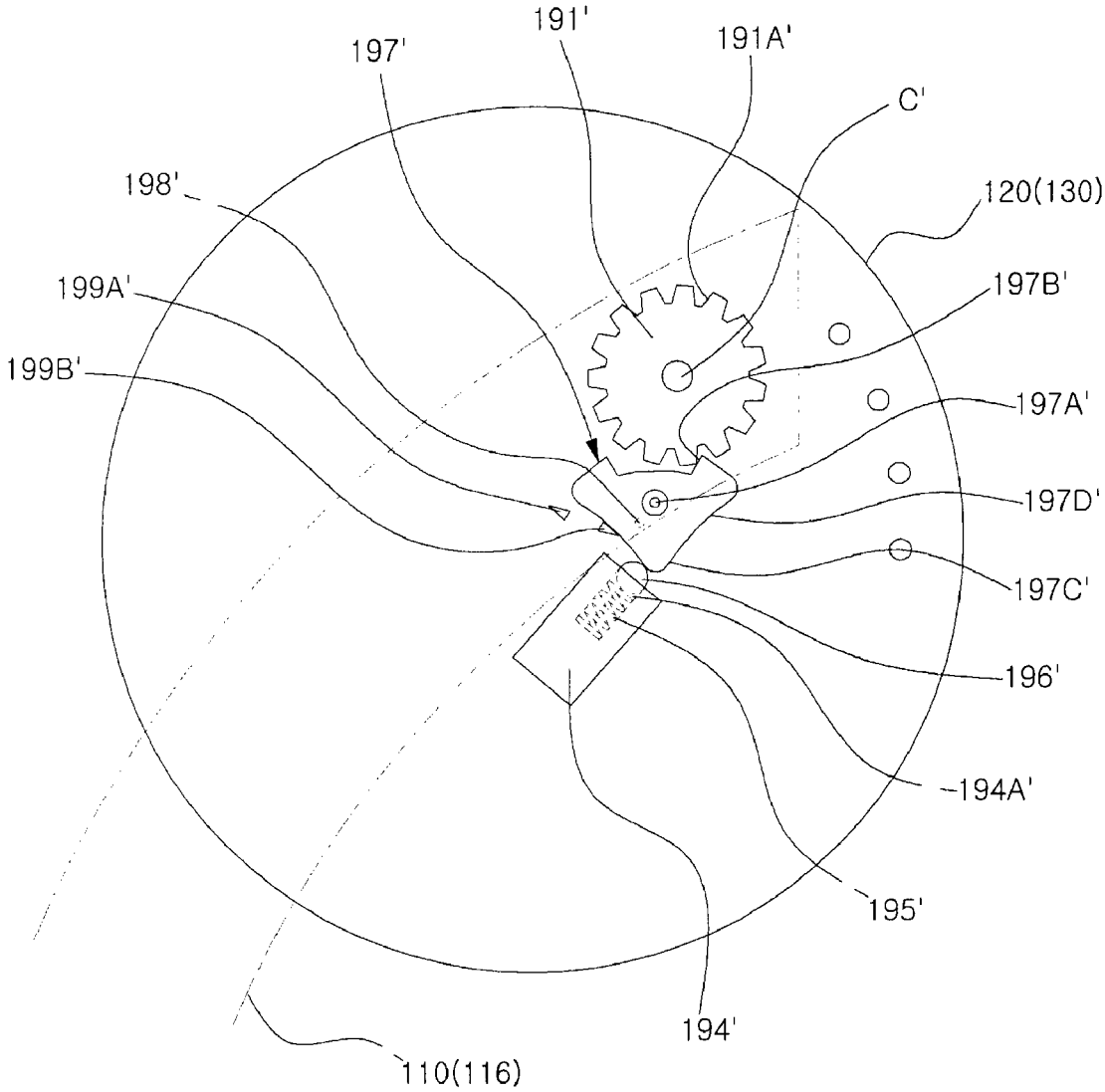
FIG. 12C shows the state after completely pulling the bow string.

As shown in FIG. 12A, one side engaging projection 197B' (upper side in FIG. 12A) formed on the ratchet 197' is engaged with the gear teeth 191A' of the ratchet gear 191', one side turnabout piece 199A' is positioned on the bottom face of the other side contact projection 197D', the support ball 196' is in the state where it is positioned in the other side direction (lower direction) from the end of the support projection 197C', and the bow string 140 is pulled. Then, as shown in FIG. 12B, the upper and lower cam members 120 and 130 rotate about the eccentric shaft C', so that the other side turnabout piece 199B' is positioned on the bottom face of one side contact projection 197D'. Herein, even when the pulled bow string 140 is pulled off, the bow string 140 and the upper and lower cam members 120 and 130 are not restored to their original states, but are maintained at their current states. In this state, when the bow string 140 is furthermore pulled, as shown in FIG. 12C, the other side turnabout piece 199B' slides in a direction of the support projection 197C', so that a direction of the ratchet 197' is turned about. Thus, the other side engaging projection 197B' (lower side in FIG. 12C) of the ratchet 197' is engaged with the gear teeth 191A', and the support ball 196' is positioned in the other side direction (upper) from the end of the support projection 197C', thereby entering an able-to-shoot state.

In this state, when the bow string 140 is pulled off, the upper and lower cam members 120 and 130 are restored, so that as shown in FIG. 12A, one side engaging projection 197B' of the ratchet 197' is engaged with the gear teeth 191A', one side turnabout piece 199A' is positioned on the bottom of the other side contact projection 197D' and thus the bow string 140 enters a drawable state, and the support ball 196 is positioned in the other side direction from the end of the support projection 197C'.

Meanwhile, the operational state of the tensioner member for adjusting the angle of the rotating unit and intensity of the bow is identical to that described before, so that the description thereof will be omitted.

Figure 13:
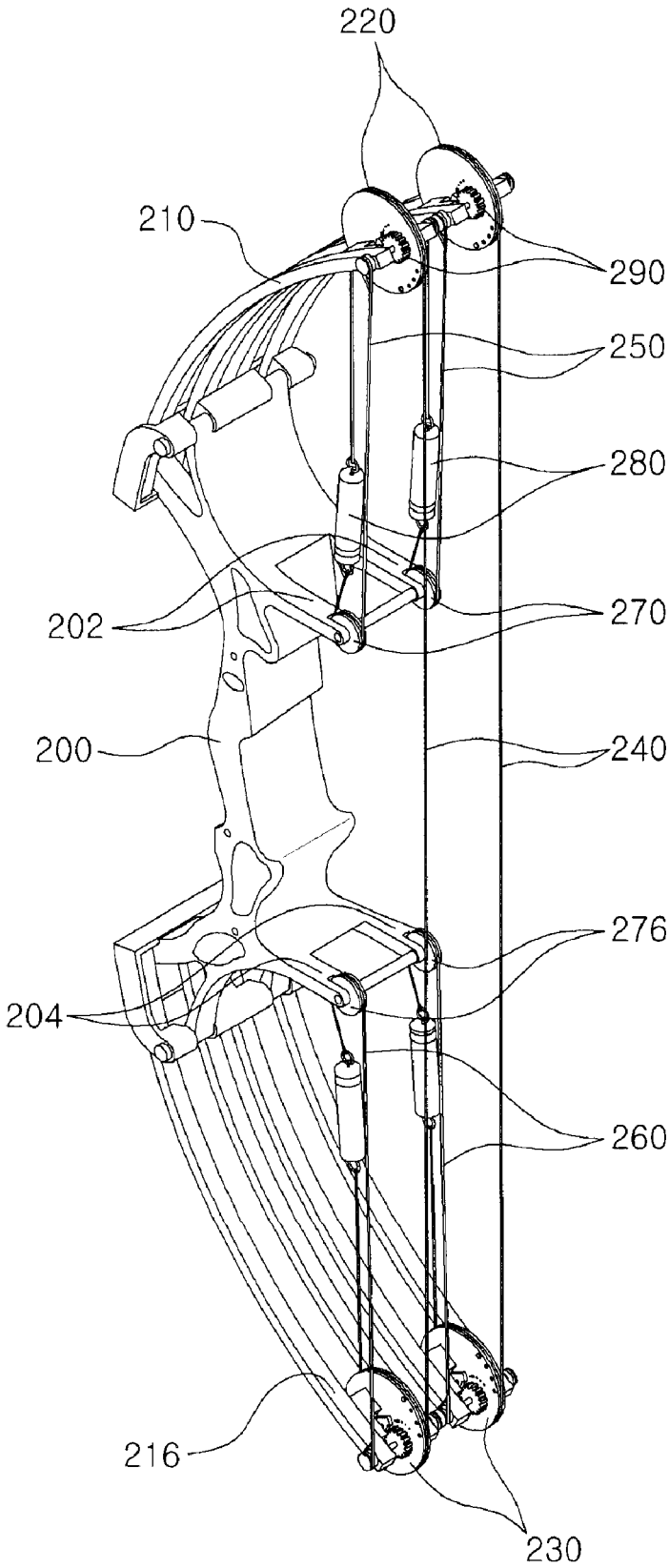
FIG. 13 is a perspective view of a compound bow according to a third embodiment of the invention.
Figure 14:
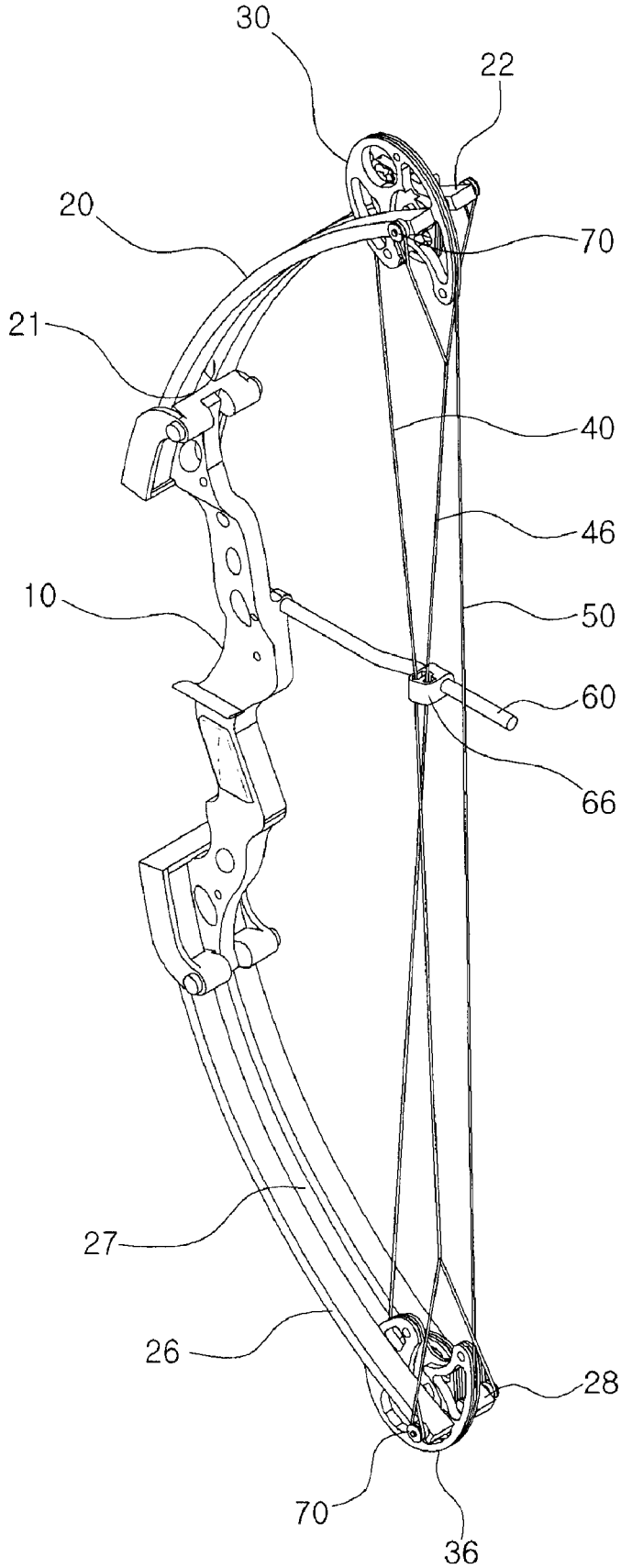
FIG. 14 is a perspective view of a compound bow according to the prior art.
Figure 15:
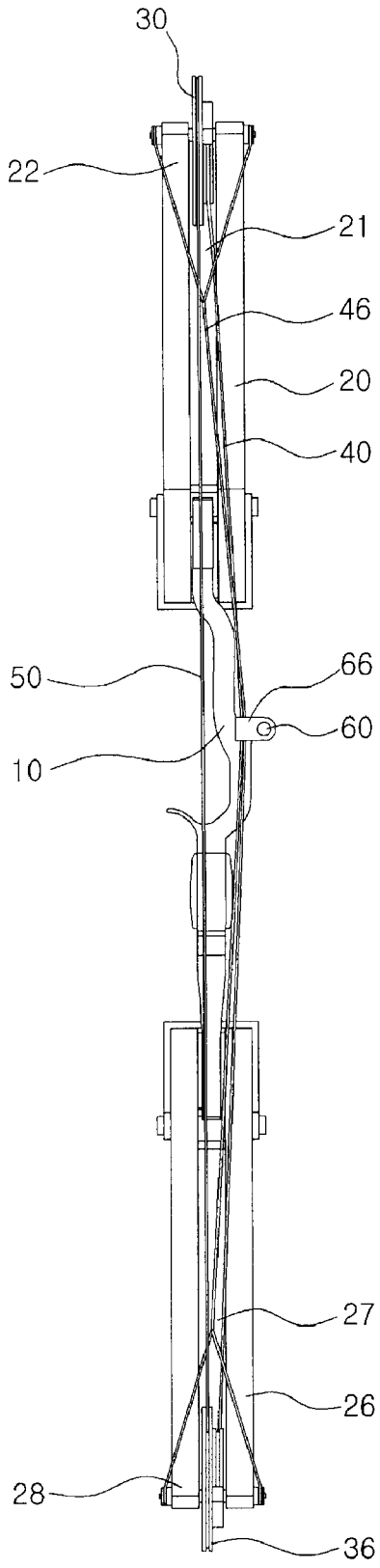
FIG. 15 is a bottom view of the compound bow of the prior art.
Figure 16:
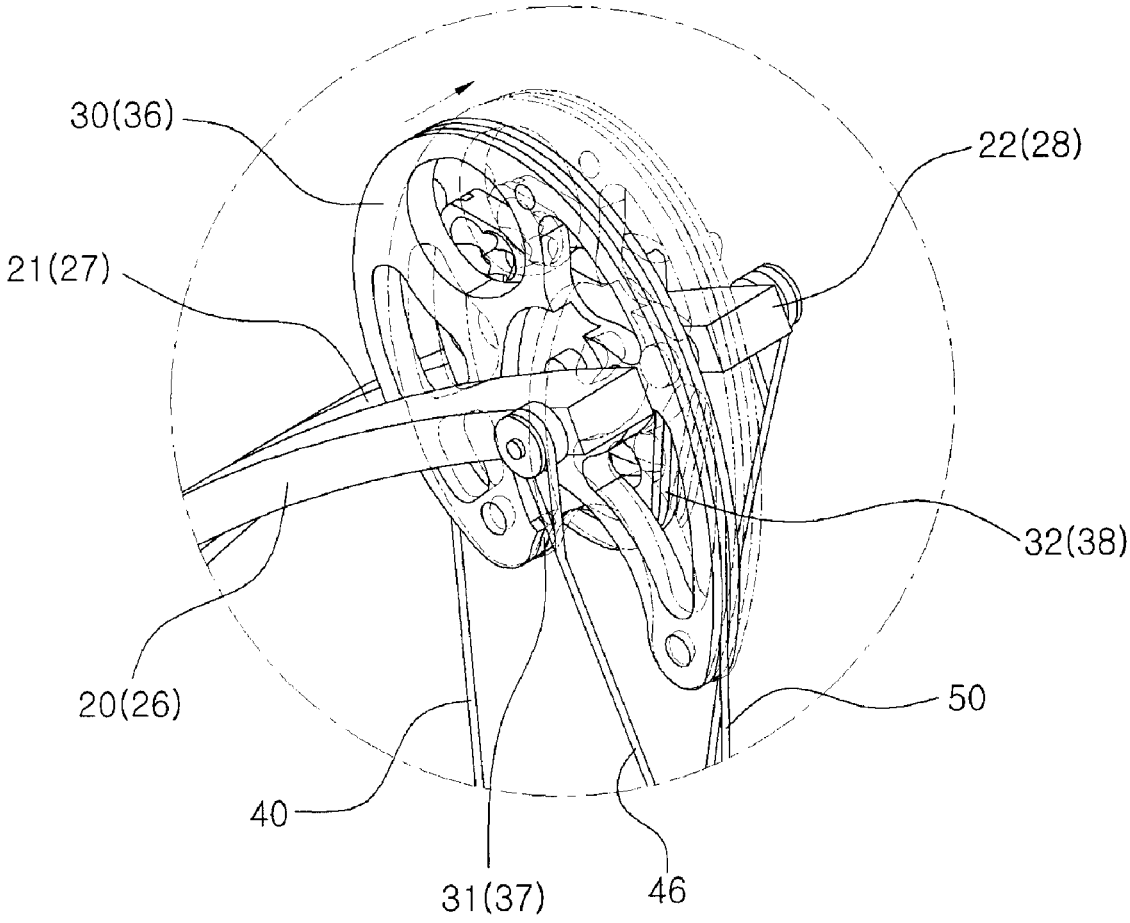
FIG. 16 is an enlarged perspective view of main parts of the prior compound bow in which a cam is distorted.

FIG. 13 is a perspective view of a compound bow according to a third embodiment of the invention. A plurality of fixing portions 202 and 204 protrudes outside from one face of a handle 200. A plurality of upper/lower cam members 220 and 230 is installed on a pair of upper/lower wings 210 and 216 longitudinally coupled to both ends of the handle 200. A bow string 240 is connected between the upper and lower cam members 220 and 230, and a plurality of upper and lower cables 250 and 260 turning about by pulleys 270 and 276 is connected to the upper and lower wings 210 and 216. A ratchet member 290 is installed on the upper/lower cam members 220 and 230 and the upper/lower wings 210 and 216, and a tensioner member 280 for adjusting an angle of the upper/lower cam members 220 and 230 and intensity of the bow is installed on the upper/lower cables 250 and 260.

The operation of the above-mentioned construction is the same as that of the first embodiment, and the above construction has advantages in that a plurality of arrows can be used at the same time, and that the hunt can be completed quickly, particularly on a plane.

While the third embodiment has illustrated that two arrows can be used at the same time, the present invention is not limited thereto, but may shoot three or more arrows according to the use purpose and the size of the compound bow.

As set forth before, the compound bow according to the present invention has effects to improve the shooting accuracy of an arrow with removal of the cable passing by the bow string, to extend the lifetime of the compound bow with the prevention of distortion in the upper/lower cam members and the upper/lower wings, to provide a strong bow and to safely use the bow with the prevention of restoration of the bow string and the upper/lower cam members upon pulling the bow string with the ratchet member, and to obtain high intensity of a bow, flying stability and high speed of an arrow by use of the cable member.

Moreover, according to the invention, maintenance and replacement of parts of the bow is easily implemented without special equipment, so that the bow can be used in the field with simple manipulation.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A compound bow comprising:

a handle having a pair of parallel fixing portions protruding outward from one surface thereof;

a pair of wing units coupled in a longitudinal direction to both ends of the handle;

a pair of rotating units rotatably coupled to the free ends of the wing units, respectively, by means of an eccentric shaft;

a bow string connected between the respective rotating units;

a pulley rotatably shaft-coupled to the fixing portion of the handle; and a pair of cable members each having one end connected to each rotating unit and the other end connected to the free end of each wing unit via the pulley;

and further comprising a tensioner member installed on one side of each cable member to control an angle of each rotating unit and intensity of the bow.

2. The compound bow as claimed in claim 1, wherein the tensioner member comprises:

a main body having an internally threaded portion formed at its inner periphery; and an adjusting bolt screw-coupled to the internally threaded portion formed at the inner periphery of the main body.

3. The compound bow as claimed in claim 1, further comprising a ratchet member installed on the respective rotating units and wing units to, upon drawing the bow string, prevent the respective rotating units from being restored, and to keep the bow string in a drawable state or an able-to-shoot state.

4. The compound bow as claimed in claim 3, wherein the ratchet member comprises:

a ratchet gear provided at one side of the respective rotating units and through which the eccentric shaft passes;

a fixing member having a fixing portion fixed to an inside face of one end of each wing unit, and an extension integrally protruding downward from the middle portion of one face of the fixing portion and having a hole thereon;

a spring installed in the hole;

a support ball provided at an inlet side of the hole so as to be forced by the spring;

a ratchet rotatably coupled to the fixing member and having, on both ends of one side thereof, engaging projections engaged with gear teeth of the ratchet gear, and on the other side thereof, a support projection resiliently supported by the support ball; and a turnabout piece provided at one side of the periphery of the ratchet gear to turn about a direction of the ratchet, coming to contact with the ratchet by the rotating motion of the respective rotating units.

5. The compound bow as claimed in claim 4, wherein the turnabout piece comprises a pair of turnabout pieces inserted to a plurality of through-holes provided at one side of the periphery of the ratchet gear in each rotating unit.

6. The compound bow as claimed in claim 3, wherein the ratchet member comprises:

a ratchet gear positioned at one side of the rotating units and fixedly installed by the eccentric shaft;

a fixing member having a fixing portion fixedly installed on one side face of the rotating units, and an extension integrally protruding downward from the middle portion of one face of the fixing portion and having a hole thereon;

a spring installed in the hole;

a support ball provided at an inlet side of the hole so as to be forced by the spring;

a ratchet rotatably coupled to the fixing member and having, on both ends of one side thereof, engaging projections engaged with gear teeth of the ratchet gear, and on the other side thereof, a support projection resiliently supported by the support ball; and a turnabout piece provided at an inner face of one end of the wing unit to turn about a direction of the ratchet, coming to contact with the ratchet by the rotating motion of the respective rotating units.

7. The compound bow as claimed in claim 6, wherein the turnabout piece comprises a pair of turnabout pieces inserted to a plurality of through-holes provided at an inner face of one end of the respective wing units;

8. The compound bow as claimed in claim 6, wherein the eccentric shaft has a polygonal sectional shape.

9. The compound bow as claimed in claim 1, wherein a plurality of length-adjusting holes is formed at one side of the periphery of the rotating units, respectively, to adjust a length of the bow string to be pulled, and a plurality of intensity-adjusting holes, to which the cable members each are connected, is formed at the other side of the periphery of the rotating units, respectively, to adjust intensity of the bow.

10. A compound bow comprising:

a handle having a pair of parallel fixing portions protruding outward from one surface thereof;

a pair of wing units coupled in a longitudinal direction to both ends of the handle;

a pair of rotating units rotatably coupled to the free ends of the wing units, respectively, by means of an eccentric shaft;

a bow string connected between the respective rotating units;

a pulley rotatably shaft-coupled to the fixing portion of the handle; and a pair of cable members each having one end connected to each rotating unit and the other end connected to the free end of each wing unit via the pulley;

and further comprising a ratchet member installed on the respective rotating units and wing units to, upon drawing the bow string, prevent the respective rotating units from being restored, and to keep the bow string in a drawable state or an able-to-shoot state.

11. The compound bow as claimed in claim 10, wherein the ratchet member comprises:

a ratchet gear provided at one side of the respective rotating units and through which the eccentric shaft passes;

a fixing member having a fixing portion fixed to an inside face of one end of each wing unit, and an extension integrally protruding downward from the middle portion of one face of the fixing portion and having a hole thereon;

a spring installed in the hole;

a support ball provided at an inlet side of the hole so as to be forced by the spring;

a ratchet rotatably coupled to the fixing member and having, on both ends of one side thereof, engaging projections engaged with gear teeth of the ratchet gear, and on the other side thereof, a support projection resiliently supported by the support ball; and a turnabout piece provided at one side of the periphery of the ratchet gear to turn about a direction of the ratchet, coming to contact with the ratchet by the rotating motion of the respective rotating units.

12. The compound bow as claimed in claim 11, wherein the turnabout piece comprises a pair of turnabout pieces inserted to a plurality of through-holes provided at one side of the periphery of the ratchet gear in each rotating unit.

13. The compound bow as claimed in claim 10, wherein the ratchet member comprises:

a ratchet gear positioned at one side of the rotating units and fixedly installed by the eccentric shaft;

a fixing member having a fixing portion fixedly installed on one side face of the rotating units, and an extension integrally protruding downward from the middle portion of one face of the fixing portion and having a hole thereon;

a spring installed in the hole;

a support ball provided at an inlet side of the hole so as to be forced by the spring;

a ratchet rotatably coupled to the fixing member and having, on both ends of one side thereof, engaging projections engaged with gear teeth of the ratchet gear, and on the other side thereof, a support projection resiliently supported by the support ball; and a turnabout piece provided at an inner face of one end of the wing unit to turn about a direction of the ratchet, coming to contact with the ratchet by the rotating motion of the respective rotating units.

14. The compound bow as claimed in claim 13, wherein the turnabout piece comprises a pair of turnabout pieces inserted to a plurality of through-holes provided at an inner face of one end of the respective wing units.

15. The compound bow as claimed in claim 13, wherein the eccentric shaft has a polygonal sectional shape.

16. A compound bow comprising:

a handle having a pair of parallel fixing portions protruding outward from one surface thereof;

a pair of wing units coupled in a longitudinal direction to both ends of the handle;

a pair of rotating units rotatably coupled to the free ends of the wing units, respectively, by means of an eccentric shaft;

a bow string connected between the respective rotating units;

a pulley rotatably shaft-coupled to the fixing portion of the handle; and a pair of cable members each having one end connected to each rotating unit and the other end connected to the free end of each wing unit via the pulley;

wherein a plurality of length-adjusting holes is formed at one side of the periphery of the rotating units, respectively, to adjust a length of the bow string to be pulled, and a plurality of intensity-adjusting holes, to which the cable members each are connected, is formed at the other side of the periphery of the rotating units, respectively, to adjust intensity of the bow.

* * * * *